US006011533A

United States Patent [19]

Aoki

[11] Patent Number: 6,011,533

[45] Date of Patent: Jan. 4, 2000

[54] IMAGE DISPLAY DEVICE, IMAGE DISPLAY METHOD AND DISPLAY DRIVE DEVICE, TOGETHER WITH ELECTRONIC EQUIPMENT USING THE SAME

[75] Inventor: Toru Aoki, Suwa, Japan

[73] Assignee: Seiko Epson Corporation, Tokyo, Japan

[21] Appl. No.: 08/836,524

[22] PCT Filed: Aug. 30, 1996

[86] PCT No.: PCT/JP96/02446

§ 371 Date: Jul. 21, 1997

§ 102(e) Date: Jul. 21, 1997

[87] PCT Pub. No.: WO97/08677

PCT Pub. Date: Mar. 6, 1997

[30] Foreign Application Priority Data

Aug. 30, 1995 [JP] Japan ..... 7-245416

[51] Int. Cl.[7] ..... G09G 3/36

[52] U.S. Cl. ..... 345/92; 345/98; 345/213; 345/99; 345/100

[58] Field of Search ..... 345/98, 99, 100, 345/92, 96, 213

[56] References Cited

U.S. PATENT DOCUMENTS

| | | | |
|---|---|---|---|
| 4,724,433 | 2/1988 | Inoue et al. | 340/805 |
| 5,122,790 | 6/1992 | Yasuda et al. | 340/784 |
| 5,170,158 | 12/1992 | Shinya | 345/98 |
| 5,448,259 | 9/1995 | Hidaka | 345/99 |
| 5,552,801 | 9/1996 | Furuhashi et al. | 345/100 |
| 5,604,511 | 2/1997 | Ohi | 345/98 |
| 5,682,175 | 10/1997 | Kitamura | 345/98 |
| 5,724,061 | 3/1998 | Kanbara | 345/100 |
| 5,731,796 | 3/1998 | Furuhashi et al. | 345/96 |
| 5,798,742 | 12/1994 | Watatani et al. | 345/98 |
| 5,844,535 | 6/1996 | Itoh et al. | 345/92 |

FOREIGN PATENT DOCUMENTS

| | | |
|---|---|---|
| 0 483 972 | 5/1992 | European Pat. Off. . |
| 0 760 508 A1 | 3/1997 | European Pat. Off. . |
| 62-40493 | 2/1987 | Japan . |
| 2-153391 | 6/1990 | Japan . |
| 2-189579 | 7/1990 | Japan . |
| 5-241536 | 9/1993 | Japan . |
| 6-82754 | 3/1994 | Japan . |
| 8-227065 | 9/1996 | Japan . |
| 9-269754 | 10/1997 | Japan . |
| WO 96/24123 | 8/1996 | WIPO . |

*Primary Examiner*—Richard A. Hjerpe
*Assistant Examiner*—Marthe Y. Marc-Coleman
*Attorney, Agent, or Firm*—Oliff & Berridge, PLC

[57] ABSTRACT

This invention relates to an image display device that samples stabilized pixel data within a sampling period, to display an image with no ghosting. A liquid crystal panel 100 consists of pixels disposed at pixel positions formed at intersections between a plurality of data signal lines 112 and a plurality of scan signal lines 110 arranged in matrix form. A scan signal line selection circuit 102 supplies a scan signal to the scan signal lines 110 in sequence. The phase-expansion circuit 32 samples an image signal having time-series data corresponding to each of said pixel positions in accordance with a first sampling period, and outputs in parallel a plurality of phase-expaned signals that have been converted to a time length of data that is longer than the first sampling period. A plurality of sampling circuits 106 connected to corresponding data signal lines 112 each receive one of the plurality of phase-expaned signals, samples the pixel data in the phase-expaned signal according to a second sampling period, and supplies a data signal to the data signal lines 112. A sampling signal generation circuit 104 generates a sampling signal having the second sampling period that is shorter than a period of time corresponding to the time length of data in the phase-expaned signals, and supplies it to the sampling circuits 106.

18 Claims, 33 Drawing Sheets

SCLK 1~6
POLARITY INVERSION TIMING SIGNAL
PICTURE SIGNAL
500a~500f
502a~502f
504a~504f
Data 1
Data 2
Data 3
Data 4
Data 5
Data 6
32
34
SW1
C
D
540
530
520
510
R1
R2
R3
R4
TR1
TR2
TR3
A
B

FIG. 25

| | | | | | | | | | | |
|---|---|---|---|---|---|---|---|---|---|---|
| V1+ | V2- | V3+ | V4- | V5+ | V6- | V1+ | V2- | ... | V1+ | V2- |
| V2- | V3+ | V4- | V5+ | V6- | V1+ | V2- | V3+ | | V2- | V3+ |
| V3+ | V4- | V5+ | V6- | V1+ | V2- | V3+ | V4- | | V3+ | V4- |
| V4- | V5+ | V6- | V1+ | V2- | V3+ | V4- | V5+ | | V4- | V5+ |
| ⋮ | | | | | | | | | | |
| V6- | V1+ | V2- | V3+ | V4- | V5+ | V6- | V1+ | | V6- | V1+ |

FIG. 26

| | | | | | | | | | | |
|---|---|---|---|---|---|---|---|---|---|---|
| a1+ | a2- | a3+ | a4- | a5+ | a6- | a7+ | a8- | ... | $a_{K-1}+$ | $a_K-$ |
| b1- | b2+ | b3- | b4+ | b5- | b6+ | b7- | b8- | | $b_{K-1}-$ | $b_K+$ |
| c1+ | c2- | c3+ | c4- | c5+ | c6- | c7+ | c8+ | | $c_{K-1}+$ | $c_K-$ |
| d1- | d2+ | d3- | d4+ | d5- | d6+ | d7- | d8- | | $d_{K-1}-$ | $d_K+$ |
| ⋮ | | | | | | | | | | |
| | | | | | | | | | | |

IMAGE DISPLAY DEVICE, IMAGE DISPLAY METHOD AND DISPLAY DRIVE DEVICE, TOGETHER WITH ELECTRONIC EQUIPMENT USING THE SAME

BACKGROUND OF THE INVENTION

1. Field of the Invention

This non-provisional application claims the benefit of Patent Cooperation Treaty (PCT) International Application No. JP96/02446, filed Aug. 30, 1996.

This invention relates to an image display device such as an active matrix liquid crystal display device, an image display method, and a display drive device, together with electronic equipment using the same. More specifically, it relates to an improvement in the operation of writing data that can reduce the occurrence of ghosting.

2. Description of Related Art

In an active matrix type of liquid crystal display device, for example, an operation of writing data to a liquid crystal layer of each of a number of pixels is implemented by a point-at-a-time scanning, through a switching element that is a thin-film transistor (TFT), where a plurality of these TFTs are connected to a single scan signal line.

However, to answer the recent demands for a device capable of handling multi-media data, such as a personal computer (PC) or engineering workstation (EWS), it is desirable to provide a display having a lot of gray levels such as 256 gray levels when displaying a natural-seeming image such as a video signal.

To adapt a prior-art digital driver to cope with this large number of gray levels, it is necessary to have a number of input signals for each color that is equal to the number of bits. For a color display of 256 gray levels, for example, the number of input signals is: 3 (R, G, and B)×8 bits=24 input signals.

With an analog driver, on the other hand, three input signals are sufficient for a color display or one for a monochrome display. In contrast to a digital driver that has discontinuous gray levels, an analog driver has continuous gray levels which gives it the advantage that it is suitable for a display that is based on a normal image signal.

Unfortunately, it is necessary to sample and hold data from within an image signal in components such as TFT switches, in order to achieve the above point-at-a-time scanning in an active matrix type of liquid crystal display device. This gives rise to a problem in that the switching characteristic of the TFT cannot follow the frequency of the input image signal fast enough. In a display device with an integral driver, the capabilities of sample-and-hold TFTs is lower than in a display device with an external driver, and thus this problem is more obvious. With a high-definition display device having a large number of pixels, the frequency of the input image signal is higher, so this problem is more obvious.

Therefore, a technique has been proposed (in Japanese Patent Application No. 6-316988) whereby the input picture signal is phase-expanded to, for example, six parallel signals as shown in FIG. 32, to increase the time length of data per pixel and reduce the frequency of the signal input to the liquid crystal panel.

This phase expansion makes it possible to increase the time length of data for each pixel and increase the resolution, even with the frequency characteristics of a TFT used as, for example, a sample-and-hold switch.

FIG. 32 shows how the time length of data for each of the phase-expanded signals that are output in parallel after the 6-phase expansion has a time length that is equal to six cycles of a reference clock signal.

When these phase-expanded signals are sampled by the sample-and-hold switch such as a TFT, the sampling period of a sampling signal that is input to the gate of the TFT, for example, is set to eight cycles of the reference clock signal, as shown in FIG. 32, as a test.

This setting is a sufficiently long sampling period with respect to the time length of data in the phase-expande signals, from consideration of the frequency following characteristics of a TFT switch. It also means that a sampling signal having this sampling period can be created easily by using a shift register alone.

However, experiments performed by the present inventors have shown that, when an attempt is made to display an arrow 1 on a screen 2, as shown schematically in FIG. 33 for example, ghosting 3 can occur in subsequent positions of travel in the scan direction, as shown by the broken line.

An objective of this invention is thus to provide an image display device, image display method, and display drive device that make it possible to reduce or prevent ghosting, even while an input image signal is being subjected to phase expansion, as well as electronic equipment that uses the same.

Another objective of this invention is to provide an image display device, image display method, and display drive device that make it possible to reduce or prevent ghosting, even when increasing speed of the dot clock signal makes it no longer possible to follow the sample-and-hold operation during the point-at-a-time scanning, as well as electronic equipment that uses that method.

SUMMARY OF THE INVENTION

According to the present invention, there is provided an image display device comprising:

- an image display portion formed of pixels disposed at pixel positions formed by intersections between a plurality of data signal lines and a plurality of scan signal lines arranged in a matrix form;
- scan signal line selection means for supplying a scan signal to the scan signal lines in sequence;
- phase-expansion means for sampling image signals each of which has time-series data corresponding to each of the pixel positions in accordance with a first sampling period, converting the image signals into a plurality of phase-expansion signals to have a plurality of pixel data, respectively, and outputting the phase-expanded signals in parallel, and a length of each of the pixel data being longer than the first sampling period for the image signals;
- a plurality of sampling means connected to the data signal lines, respectively, each of the plurality of sampling means receiving one of the phase-expanded signals, sampling the plurality of pixel data in a received phase-expanded signal in accordance with sampling signals having second sampling periods, and supplying sampled pixel data as a data signal to one of the data signal lines; and
- sampling signal generation means for generating the sampling signals which have the second sampling periods which are each shorter than a period of time corresponding to a time length of each of the pixel data in the phase-expanded signals, and for supplying the sampling signals to the plurality of sampling means.

This invention functions as described below to reduce or prevent ghosting that is a technical problem addressed by this invention.

First of all, the present inventor has determined that the cause of ghosting is the intrusion of unwanted components in the waveform supplied through the sampling means to each pixel, as shown in FIG. 34. The intrusion of unwanted components within this waveform is caused by an extension of the second sampling period to eight cycles of the dot clock signal, in comparison with the time length of data in the phase-expanded signal which is six cycles of the dot clock signal, as shown in FIG. 32.

Therefore, taking as an example the video n signal line of FIG. 32, sampling signals S/H(n), S/H(n+6), and S/H(n+12) implement the sampling while there are overlapping periods of time therebetween, so that during the initial sampling period of S/H(n+6), for example, the S/H(n+6) sampling signal samples sampling data while S/H(n) is still sampling.

The phenomenon in this case can be observed from the potential waveform supplied to the liquid crystal layer. As a result, data for the arrow 1 is written into the unsuitable liquid crystal layer by the sampling means, so that unwanted components intrude in the waveform and a region that ought to be at a low level reaches a higher level at a potential corresponding to the ghosting 3, as shown in FIG. 34.

This invention makes it possible to set the second sampling period of the sampling signal to be always shorter than the time length of data in the phase-expanded signals, as shown in FIGS. 8, 11, 14, and 17, reducing the influences of other data on original data, and thus reducing or preventing ghosting.

With this invention, the phase-expansion means may output the phase-expanded signals in parallel with different head positions of the pixel data in the phase-expanded signals on the basis of a reference clock signal. During this time, the sampling signal generation means may supply the sampling signals to the plurality of sampling means with different head positions of the second sampling periods in the sampling signals. This ensures that the pixels connected to each of the scan signal lines can be driven by a point-at-a-time scanning.

The sampling signal generation means may comprise a shift register and a plurality of AND circuits.

This shift register has a plurality of stages in which an output signal from each stage is output at a timing that partially overlaps a phase of a preceding-stage output signal. More specifically, the shift register can sequentially shift an input signal, which has a pulse width that is 2N (where N is an integer) times one cycle of the reference clock signal, later than the preceding output signal by one cycle of the reference clock signal. In an example shown in FIG. 7A, N=4 and thus the pulse width of an input signal DX is eight times one cycle of a dot clock signal DC. In another example shown in FIG. 10, N=3 and thus the pulse width of the input signal DX is six times one cycle of the dot clock signal DC. In yet another example shown in FIG. 13, N=2 and thus the pulse width of the input signal DX is four times one cycle of the dot clock signal DC.

Each of the AND circuits connected to one of the plurality of sampling means may receive two of the output signals of mutually overlapping signal phase from the shift register, AND the two output signals, and output the AND as the sampling signal to the connected sampling means.

Thus the nth and (n+N)th (where: $1 \leqq n \leqq$(total number of pixels on one scan signal line)) outputs of the shift register are input to the AND circuit connected to the nth sampling means, and the second sampling period for the sampling signal that is the AND thereof is N times one cycle of the reference clock signal.

If, for example, n is assumed to be 1 in an embodiment in which N=4, as shown in FIG. 6, the first and fifth shift register outputs are input to an AND circuit 160*a* to produce the second sampling period as shown in FIG. 7, which is four (=N) times one cycle of the dot clock signal DC.

If, for example, n is assumed to be 1 in an embodiment in which N=3, as shown in FIG. 9, the first and fourth shift register outputs are input to the AND circuit 160*a* to produce the second sampling period as shown in FIG. 10, which is three (=N) times one cycle of the dot clock signal DC.

If, for example, n is assumed to be 1 in an embodiment in which N=2, as shown in FIG. 12, the first and third shift register outputs are input to the AND circuit 160*a* to produce the second sampling period as shown in FIG. 13, which is two (=N) times one cycle of the dot clock signal DC.

The phase-expansion means of this invention may output the phase-expanded signals in parallel with head positions of the pixel data thereof aligned. In that case, the sampling signal generation means may supply the sampling signals to the plurality of sampling means connected to the data signal lines, the number of which is equal to the total number of phase-expanded signal lines while the sampling signals may start sampling simultaneously. Thus, as shown in FIG. 17, the pixels connected to each of the scan signal lines can be simultaneously driven by a predetermined number which is equal to the total number of the phase-expanded signal lines.

The sampling signal generation means may comprise a shift register which outputs a signal later than a preceding signal by one cycle of a reference clock signal. More specifically, the shift register can sequentially shift an input signal, which has a pulse width that is 2N (where N is an integer) times one cycle of the reference clock signal, later than the preceding output signal by one cycle of the reference clock signal.

In the example of FIG. 16, N=4 and thus the pulse width of the input signal DX is eight times one cycle of the dot clock signal DC.

This ensures that, during an mth simultaneous drive {where: $1 \leqq m \leqq$ (total number of pixels on one scan signal line)/(total number of the phase-expanded signal lines)}, the (3m−2)th output of the shift register within one horizontal scanning period of time can be input to the plurality of sampling means, and the second sampling period of the sampling means can be N times one cycle of the reference clock signal.

If m is the first simultaneous drive in the example of FIG. 15, for instance, the (3m−2)th shift register output, which is the first shift register output, is input to the six sampling means 106. In a similar manner, if m is the second simultaneous drive, (3m−2) gives the fourth shift register output that is input to the next six sampling means 106; and if m is the third simultaneous drive, (3m−2) gives the seventh shift register output that is input to the next six sampling means 106.

With this invention, the image display portion may be a liquid crystal panel in which a liquid crystal is placed between a pair of substrates;

wherein the plurality of sampling means may be configured of a plurality of thin-film transistors (TFT) formed on one of the substrates; and wherein the sampling signals from the sampling signal generation means may be supplied to gates of the thin-film transistors.

The write capabilities of a TFT are limited, but the sufficiently long second sampling period can be ensured by inputting phase-expanded signals having pixel. data with a long time length of data, and, since previous pixel data is not written during the second sampling period, the intrusion of unwanted components into the waveform can be reduced, making it possible to effectively prevent ghosting.

The image display portion of the present invention may be driven by applying a voltage that is a difference between voltages applied to one side of the pixel through the data signal lines and the other side of the pixel, into the liquid crystal at the pixel positions to invert a polarity of an electric field applied to the liquid crystal.

In such a case, the image display device may comprise polarity inversion means in a stage before the phase-expansion means, for receiving the image signals, generating a first-polarity image signal which drives the pixels at a first polarity with respect to a polarity inversion reference potential and a second-polarity image signal which drives the pixels at a second polarity that is the opposite of the first polarity, and outputting one of the first- and second-polarity image signals to the phase-expansion means. During this time, the phase-expansion means performs phase expansion for the first- and second-polarity image signals and outputs first- and second-polarity phase-expanded signals.

This polarity inversion means may further comprise first polarity inversion means for outputting one of the first- and second-polarity image signals and a second polarity inversion means for outputting the other of the first- and second-polarity image signals.

With this invention, the image display device may comprise a plurality of polarity inversion means in a stage after the phase-expansion means, for receiving one of the phase-expanded signals, generating a first-polarity phase-expanded signal which drives the pixels at a first polarity with respect to a polarity inversion reference potential and a second-polarity phase-expanded signal which drives the pixels at a second polarity that is the opposite of the first polarity, and outputting one of the first- and second-polarity phase-expanded signals to the plurality of sampling means.

In that case, each of the plurality of polarity inversion means may comprise a first polarity inversion means for outputting one of the first- and second-polarity phase-expanded signals and a second polarity inversion means for outputting the other of the first- and second-polarity phase-expanded signals.

The image display device of this invention may further comprise:

switching means for switching between the plurality of phase-expanded signals (or between the first- and second-polarity phase-expanded signals) for supply to the plurality of sampling means; and changing control means for controlling change of a phase-expansion sequence performed by the phase-expansion means, and also controlling change of destinations of the plurality of phase-expanded signals (or the first- and second-polarity phase-expanded signals) in the switching means, in accordance with the phase-expansion sequence.

This makes it possible to prevent over-emphasis of vertical lines on the screen, caused by variations in the DC offset component generated in each phase-expanded signal, for example.

The display drive device of this invention can also act as an external circuit for an image display portion.

BRIEF DESCRIPTION OF DRAWINGS

The invention will be described in detail with reference to the following drawings in which like reference numerals refer to like elements and wherein:

FIG. 25 is a schematic diagram of the alignment of buffer outputs, shown in FIG. 23, against pixel positions in the case of driving by polarity inversion per dot;

FIG. 26 is a schematic diagram of the polarity of pixel data in the case of driving by polarity inversion per dot, achieved by the buffer outputs shown in FIG. 25;

DETAILED DESCRIPTION OF PREFERRED EMBODIMENTS

Embodiments in which this invention is applied to an active matrix type of liquid crystal display device are described below, with reference to the accompanying figures.

(1) First Embodiment

Basic Configuration of Device

Figure 1:
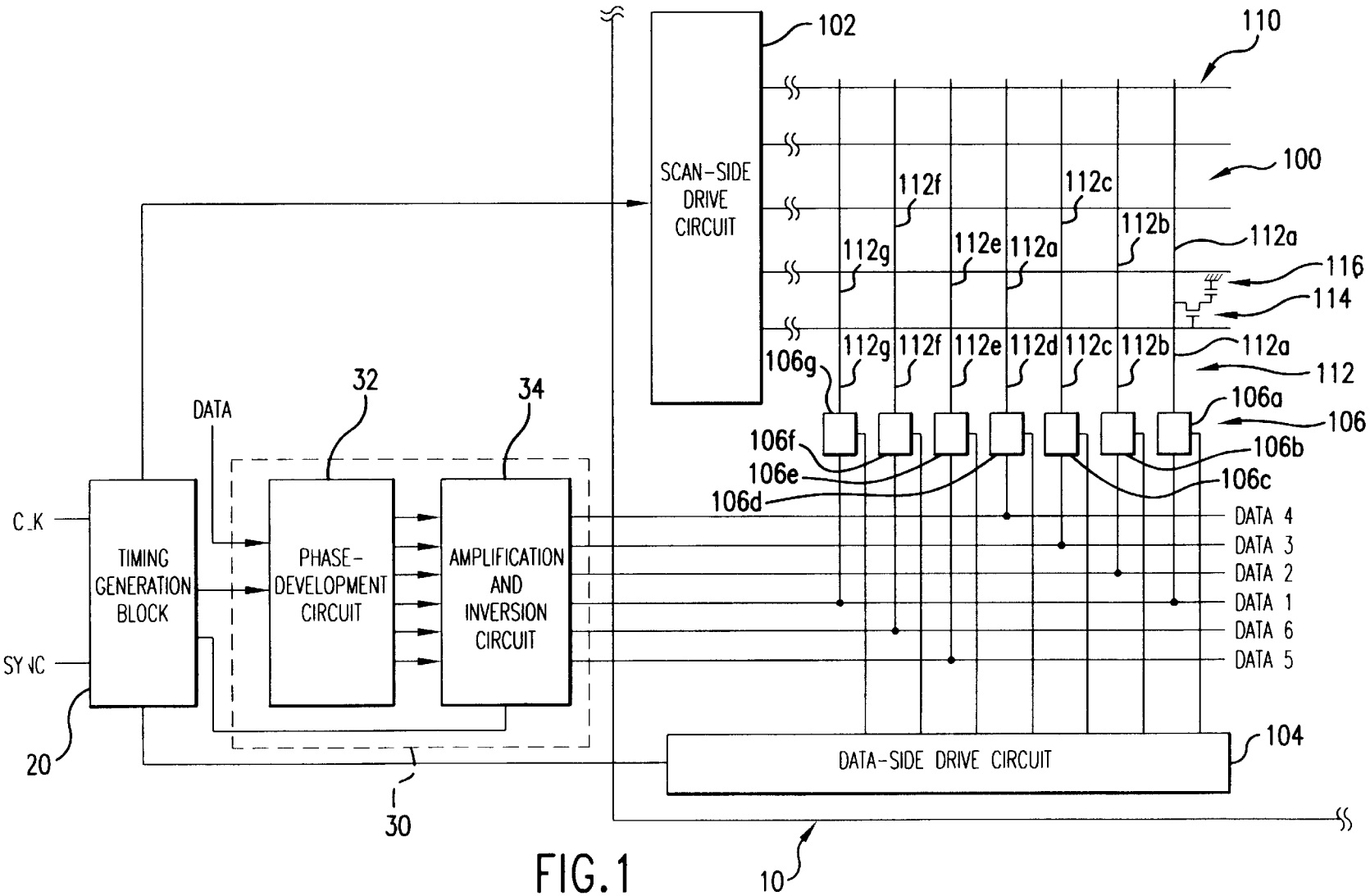
FIG. 1 is a schematic diagram of an active matrix type of liquid crystal display device of a first embodiment of this invention.

The entire concept of a liquid crystal display device in accordance with a first embodiment is shown in FIG. 1. As shown in this figure, this liquid crystal display device is a compact liquid crystal display device used as a light valve of a liquid crystal projector as one example of electronic equipment, and is divided into a liquid crystal panel block 10, a timing generation circuit block 20, and a data processing circuit block 30.

The timing generation circuit block 20 receives a clock signal CLK and a synchronization signal SYNC, and outputs a predetermined timing signal.

The data processing circuit block 30 has a phase-development circuit 32 and an amplification and inversion circuit 34. The phase-expansion circuit 32 receives a image signal "Data" (this embodiment concerns a grayscale display, so there is only one image signal), subjects pixel information to n-phase expansion (where n is six phases in FIG. 1), and outputs n phase-expanded signals in parallel. Note that, if a liquid crystal panel 100 within the liquid crystal panel block 10 is a color liquid crystal panel having color filters for the three primary colors, the phase-expansion circuit 32 receives three image signals (R, G, and B) and is capable of generating six phase-expanded signals from these three image signals. This n-phase expansion will be described later.

The amplification and inversion circuit 34 amplifies the n phase-expanded signals to the voltage required for driving the liquid crystal panel, and subjects them to a polarity inversion with reference to a polarity inversion reference potential if necessary. Note that the positions of the amplification and inversion circuit 34 and phase-expansion circuit 32 shown in FIG. 1 could be reversed. In other words, the image signals could be amplified and inverted by the amplification and inversion circuit 34 then subjected to phase expansion by the phase-expansion circuit 32.

For the 6-phase expansion, the output lines of the data processing circuit block 30 of this embodiment are six lines, "Data1" to "Data6", as shown in FIG. 1.

The liquid crystal panel block 10 is provided with the liquid crystal panel 100, a scan-side drive circuit 102, and a data-side drive circuit 104 on the same circuit substrate. Note that these circuits could equally well be separated from the substrate of the liquid crystal panel, or they could be configured as an external IC chip.

On the liquid crystal panel 100 are formed a plurality of scan signal lines 110 which extend in the row direction by way of example in FIG. 1 and a plurality of data signal lines 112 which extend in the column direction by way of example in FIG. 1. Note that, in this embodiment, the total number of scan signal lines 110 is 492 and the total number of data signal lines 112 is 652. A display element consisting of a switching element 114 and a liquid crystal layer 116 connected in series is; constructed at each pixel position created by the intersection of the lines 110 and 112, to form a pixel. A period of time during which the switching element 114 is. on is called a selected period and a period of time during which it is off is called a non-selected period. A holding capacitor (not shown in the figure) which holds in the non-selected period a voltage that is supplied during the selected period to the liquid crystal layer 116 through the switching element 114 is connected to the liquid crystal layer 116. In this embodiment, the switching element 114 could be configured of a 3-terminal type of switching element such as a TFT. Note, however, that it is not limited thereto; a 2-terminal type of switching element such as a metal-insulator-metal (MIM) element or metal-insulator-semiconductor (MIS) element could be used therefor. Note that the liquid crystal panel 100 of this embodiment is not limited to an active matrix type of liquid crystal display device using 2-terminal or 3-terminal switching; it can equally well be another type of liquid crystal panel such as a passive matrix type of liquid crystal display panel. The liquid crystal panel 100 of this embodiment has a first substrate on which are formed the scan signal lines 110 and the data signal lines 112, together with the TFTs connecting these lines. In this first substrate are also formed pixel electrodes connected to the TFTs and holding capacitors that use each of the pixel electrodes as an electrode on one side. The liquid crystal panel 100 also has a second substrate which is disposed facing the first substrate and on which is formed a common electrode. A liquid crystal is inserted between the first and second substrates to form the liquid crystal panel 100. One side of a liquid crystal layer at each pixel position acts as a pixel electrode and another side acts as a common electrode, and an electric field is applied to the liquid crystal layer by these two electrodes.

The scan-side drive circuit 102 outputs to a plurality of scan signal lines 110*a*, 110*b*, etc., a scan signal in which a selected period has been set, to sequentially select the scan signal line 110.

The data-side drive circuit 104 outputs a sampling signal to sample-and-hold switches 106 disposed between the six phase-expanded signal lines Data1 to Data 6, which are the output lines of the data processing circuit block 30, and the data signal lines 112*a*, 112*b*, etc., of the liquid crystal panel 100, for driving the liquid crystal panel 100 by the point-at-a-time scanning.

Note that the first phase-expanded signal line Data1 is connected to a first data signal line 112*a* through a sample-and-hold switch 106*a*. In a similar manner, the second to sixth phase-expanded signal lines Data2 to Data6 are each connected to second to sixth data signal lines 112*b* to 112*f* through sample-and-hold switches 106*b* to 106*f*. The first phase-expanded signal line Data1 is also connected to a seventh data signal line 112*g* through a sample-and-hold switch 106*g*. Similarly, the first phase-expanded signal line Data1 is connected to every sixth data signal line onward. In a similar manner, the second to sixth phase-expanded signal lines Data2 to Data6 are each connected to every sixth data signal line onward from the second to sixth data signal lines 112*b* to 112*f*.

The n-Phase Expansion Operation

Figure 2:
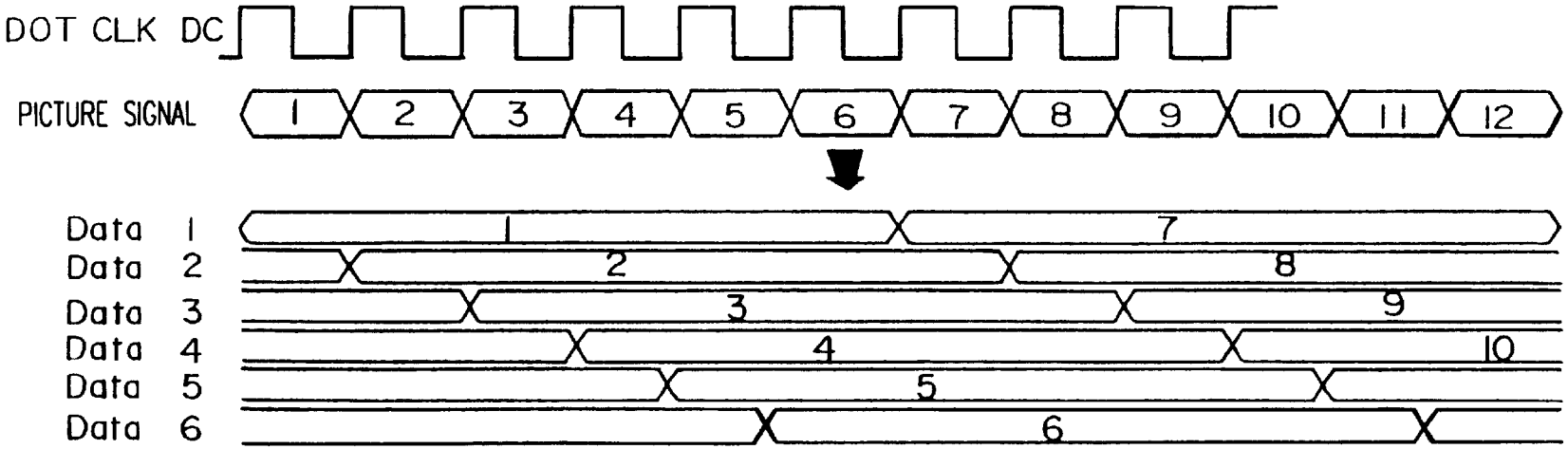
FIG. 2 is a schematic diagram used for illustrating six phase-expansion drive.

The description now turns to the operation of n-phase expansion, such as 6-phase expansion, by the phase-expansion circuit 32 of the data processing circuit block 30, with reference to FIG. 2.

As shown in FIG. 2, the image signal that is input to the data processing circuit block 30 is an analog signal having time-series data corresponding to each pixel in the liquid crystal panel 100. The phase-expansion circuit 32 that performs the 6-phase expansion samples this image signal in accordance with a reference clock signal such as a dot clock signal DC which has a first sampling period. It then generates six phase-expanded signals that have been converted to have a data length that is longer than the sampling period with which this image signal was sampled. In this embodiment, the data is extended to a length that is an integral multiple of one cycle of the dot clock signal DC, to give six parallel phase-expanded signals. This means that the phase-expansion circuit 32 has a function for extending the data length and a function for converting the serial image signal into parallel image signals. With the first phase-expanded signal that is output on the first phase-expanded signal line Data1, for example, data for the first, seventh, and thirteenth pixels of the picture signal is extended to a time length of data that is six times one cycle of the dot clock signal DC. Similarly, the data for every sixth pixel onward is extended to that time length of data.

The second phase-expanded signal that is output on the second phase-expanded signal line Data2 is processed in a similar manner so that data for the second, eighth, fourteenth, etc., pixels is extended to that data length for output.

With this embodiment, this extension and expansion operation is performed by using an analog interface IC to give 6-phase expansion of an analog picture signal.

Note that each of the first to sixth phase-expanded signals that are output on the first to sixth phase-developed signal lines Data1 to Data6 is output in a state such that the head position of each set of pixel data is sequentially shifted by one cycle of the dot clock signal DC from the preceding phase-expanded signal.

Figure 3:
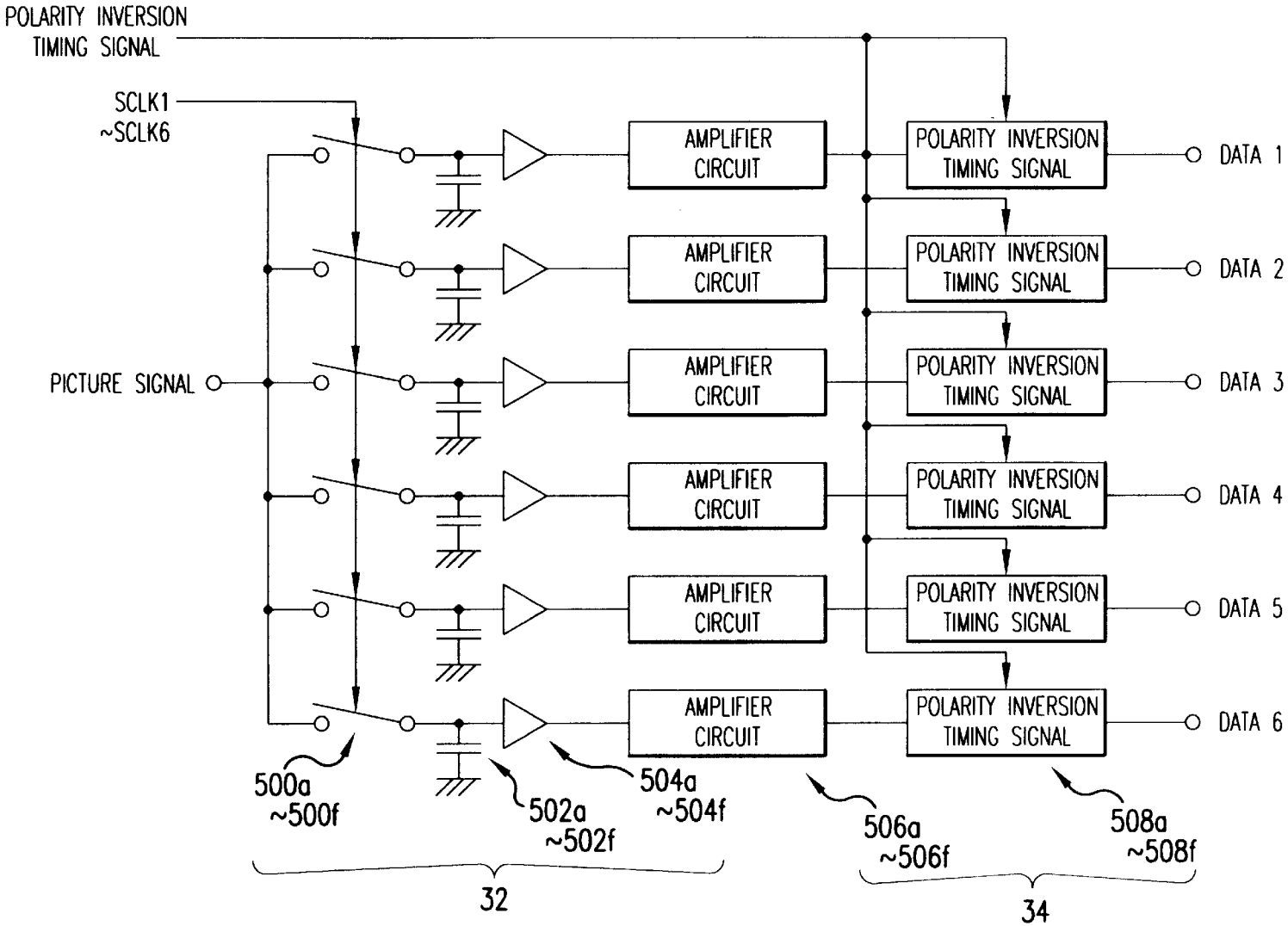
FIG. 3 is a circuit diagram of an example of the circuit configuration of the data processing circuit block of FIG. 1.
Figure 4A:
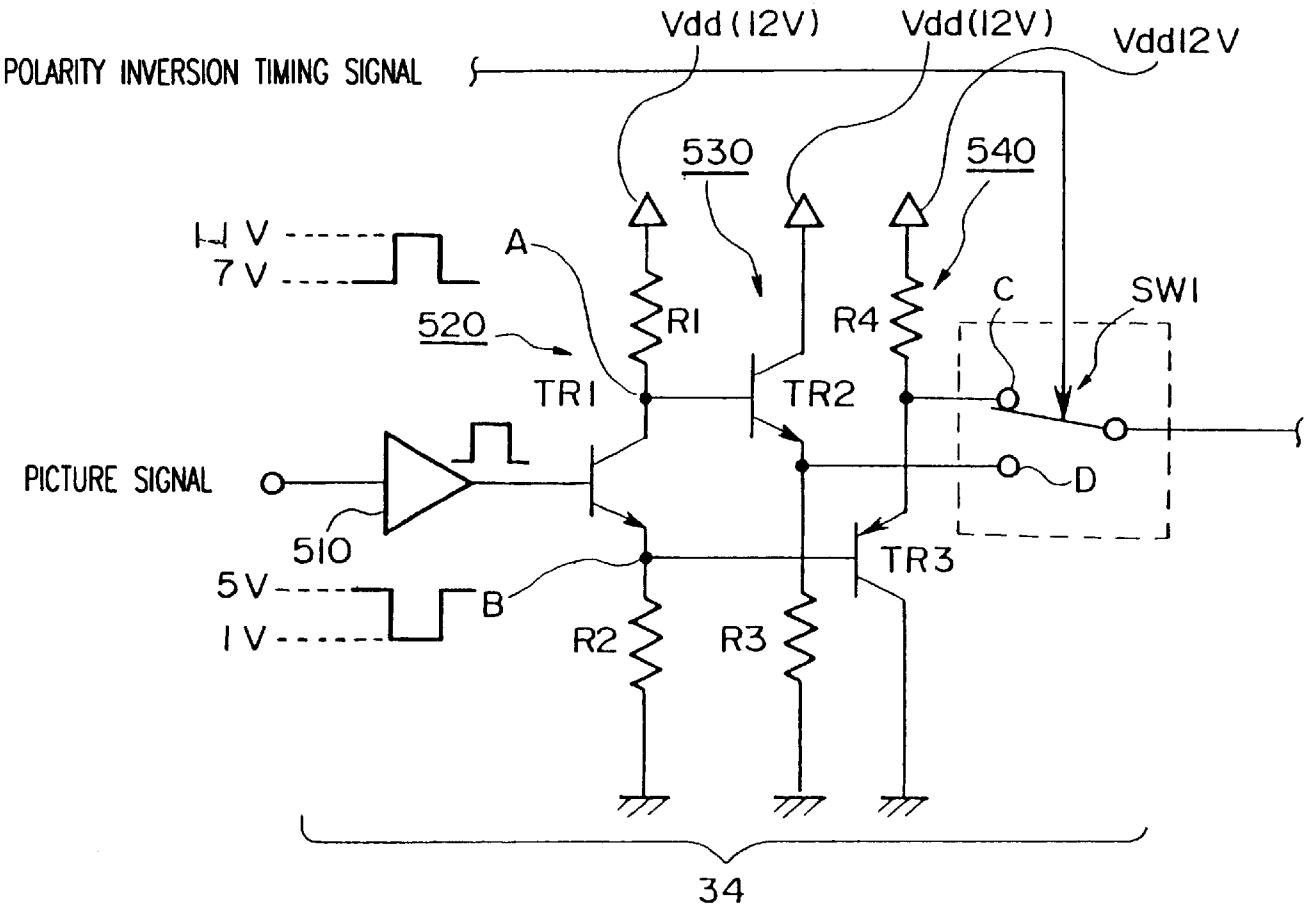
FIGS. 4A and 4B are circuit diagrams of specific examples of the amplification and polarity inversion circuits of FIG. 3.
Figure 4B:
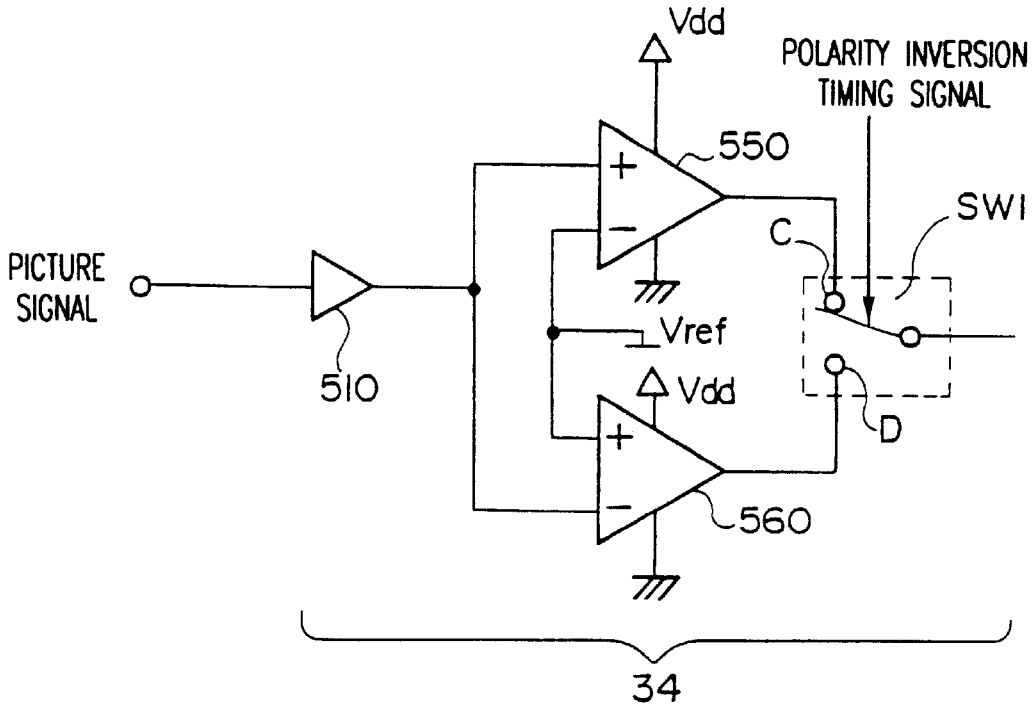
Figure 5:
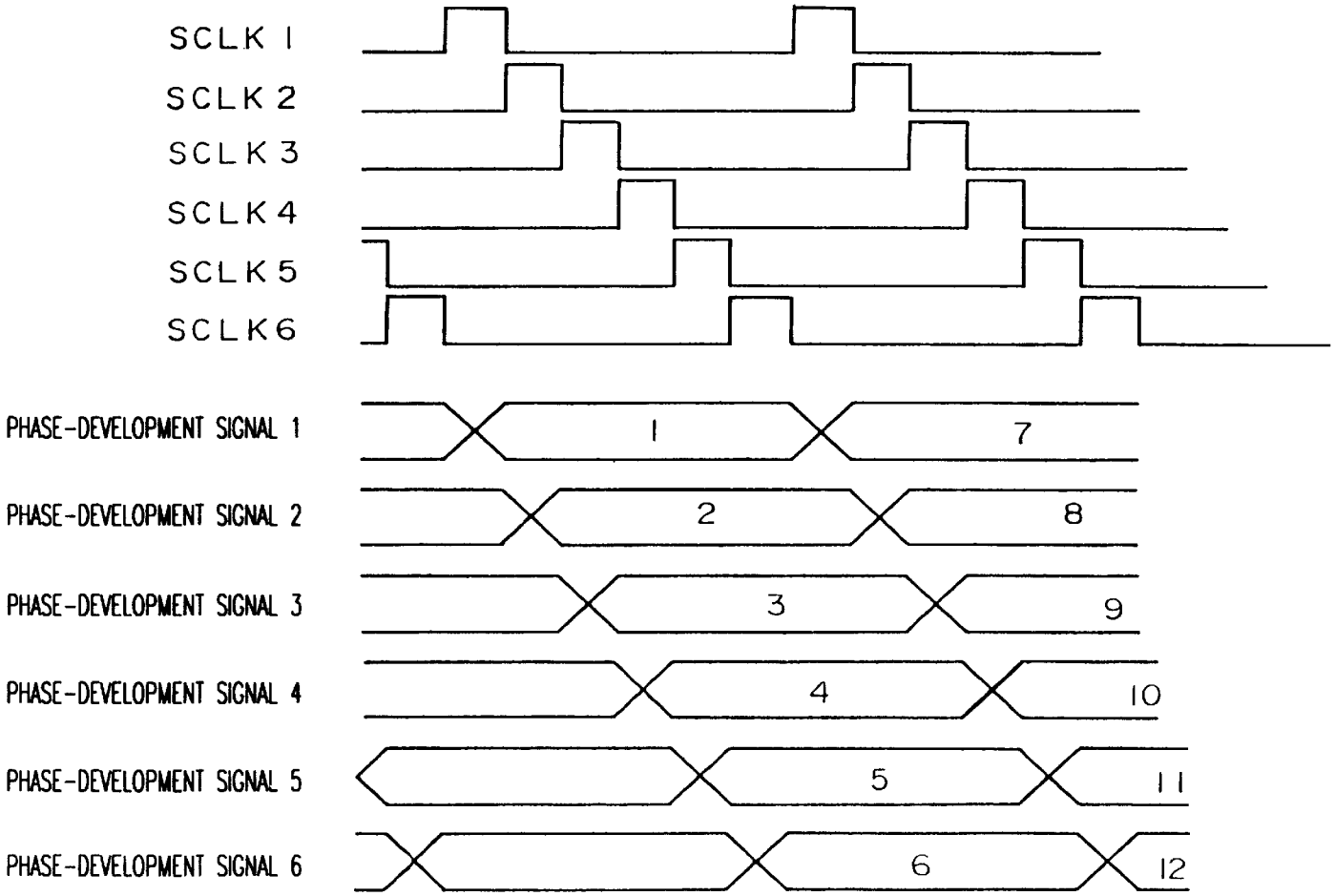
FIG. 5 is a timing chart of the operation of the phase-expansion circuit of FIG. 3.

Specific Description of 6-Phase Expansion Circuit and Polarity Inversion Circuit Specific examples of the 6-phase expansion circuit and polarity inversion circuit are shown in FIGS. 3, 4A, and 4B. In FIG. 3, the phase-expanded circuit 32 is configured of switches 500*a* to 500*f*, capacitors 502*a* to 502*f*, and buffers 504*a* to 504*f*. Sampling clock signals SCLK1 to SCLK6 of phases that are different as shown for example in FIG. 5 are each input to the switches 500*a* to 500*f* in a one-to-one relationship. Each of these switches 500*a* to 500*f* samples data when turned on by the corresponding clock signal, to charge data voltage in the corresponding subsequent-stage capacitors 502*a* to 502*f*. Each of these switches 500*a* to 500*f* holds a data potential while it is turned off by the corresponding clock signal. This provides the six phase-expanded signals through the buffers 504*a* to 504*f*, as shown in FIG. 5.

The amplifier circuits 506*a* to 506*f* and polarity inversion circuits 508*a* to 508*f* are provided in a stage after the buffers 504*a* to 504*f*. Examples of these amplifier circuits and polarity inversion circuits are shown in FIGS. 4A and 4B.

As shown in FIG. 4A, each amplifier circuit is configured of, for example, a video amplifier 510 (this could be an operational amplifier). The polarity inversion circuit has a polarity inversion section 520 configured of resistors R1 and R2 and a first transistor TR1, a buffer 530 configured of a resistor R3 and a second transistor TR2, a buffer 540 configured of a resistor R4 and a third transistor TR3, and a switch SW1 that selects the output of either of the buffers 530 and 540.

To simplify the description, the output of the video amplifier 510 is assumed to have a rectangular waveform, as shown in FIG. 4A. In this case, the resistances of the resistors R1 and R2 are assumed to be substantially the same and Vdd is 12 V. The potentials at a point A and a point B in FIG. 4A are substantially linearly symmetrical about an intermediate potential, such as 6 V. The potential of point A is, for example, 11 V for the black level and 7 V for the white level, and the potential at point B is, for example, 1 V for the black level and 5 V for the white level. Thus the two picture signals appearing at points A and B have opposite polarities with reference to a polarity inversion reference potential that is between the black levels of the two signals.

In this embodiment, the signal appearing at point B is assumed to be a negative-polarity image signal and that at point A is assumed to be a positive-polarity image signal. Note that the polarity acting as a reference for the polarity inversion is the central potential between the power potential Vdd and the ground potential GND, in other words, it is an amplitude center potential Vref for the analog image signal.

The negative-polarity signal appearing at point B is output to a terminal C through the buffer 540 and the positive-polarity signal appearing at point A appears at a terminal D through the buffer 530. One of these positive-polarity and negative-polarity phase-expanded signals is selected for output by the switch SW1, which flips on the basis of the polarity inversion timing signal.

Another example of the amplifier circuits 506*a* to 506*f* and polarity inversion circuits 508*a* to 508*f* of FIG. 3 is shown in FIG. 4B. The example of FIG. 4B is provided with an amplifier circuit 510 and differential amplifier circuits 550 and 560. The level of a image signal that is input to the differential amplifier circuit 550 through the amplifier circuit 510 is a positive-polarity potential with respect to the previously described amplitude center potential Vref, and it is output to a terminal C from the differential amplifier circuit 550. In a similar manner, the level of a image signal that is input to the differential amplifier circuit 560 through the amplifier circuit 510 is a negative-polarity potential with respect to the previously described amplitude center potential Vref, and it is output to a terminal D from the differential amplifier circuit 560. The potentials at the terminals C and D are switched by the switch SW1 on the basis of the polarity inversion timing signal, and are thus selected for output.

In the example shown in FIG. 3, six amplifier circuits 506*a* to 506*f* and six polarity inversion circuits 508*a* to 508*f* are necessary since the amplification and polarity inversion are implemented after the phase expansion. However, since the capacitors 502*a* to 502*f* can store the signal charge at a stage before the signal is amplified, when the signal amplitude is small, the time required for charging is small, so this method is advantageous in that it can be made faster.

Data Sampling Configuration

Details of the data-side drive circuit 104 that is a characteristic component of this embodiment will now be described with reference to a circuit diagram of FIG. 6 and a timing chart of FIG. 7.

Figure 6:
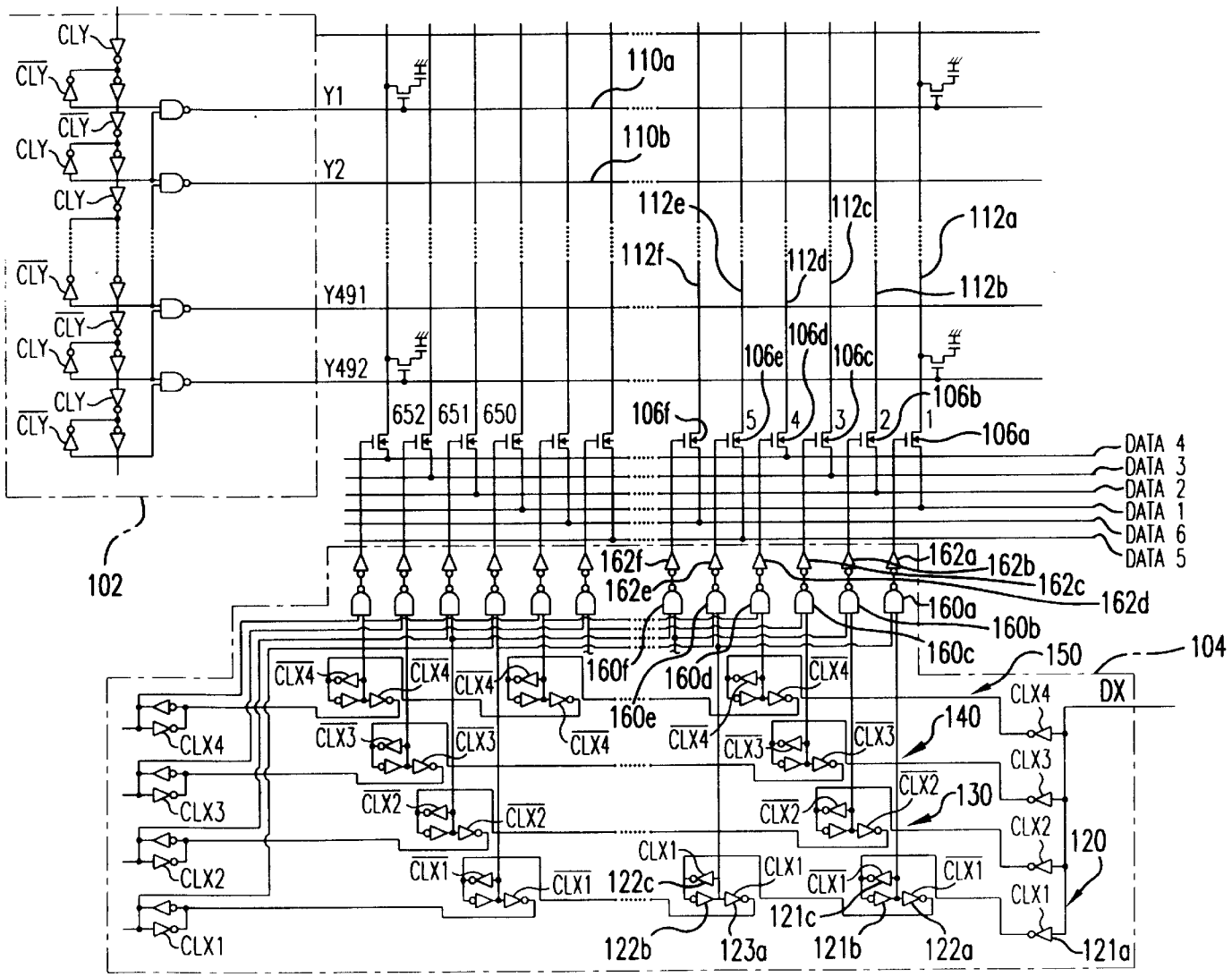
FIG. 6 is a circuit diagram of details of the data-side drive circuit of the first embodiment.
Figure 7A:
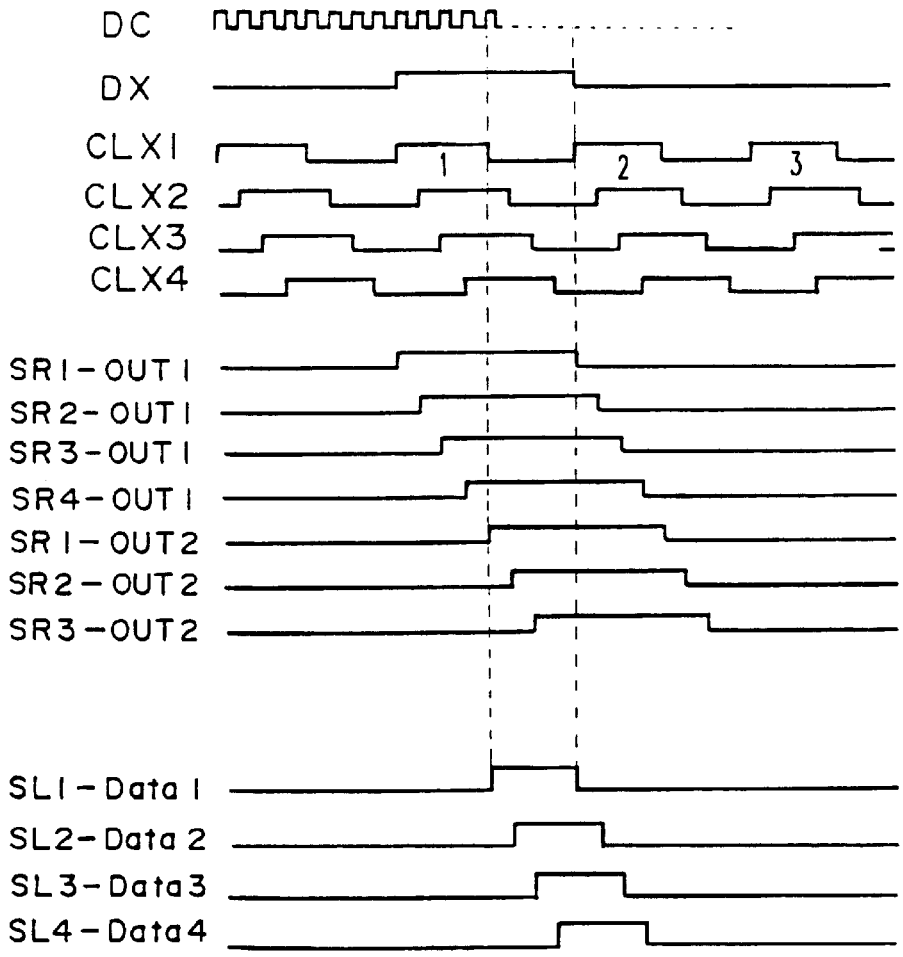
FIG. 7A is a timing chart of the data-side drive circuit of FIG. 6.

This data-side drive circuit 104 has shift registers 120, 130, 140 and 150 for first to fourth columns, as shown in FIG. 6. The shift registers 120 to 150 each receive an input signal DX that forms common shift data, as shown in FIG. 7A. This input signal DX is high for eight cycles of the dot clock signal DC, as shown in FIG. 7A. A first clock signal CLX1 and a first inverted clock signal thereof are input to the shift register 120 of the first system, as shown in FIG. 6. As the first clock signal CLX1, a pulse of half the width of the input signal DX is output repeatedly at a cycle that is the pulse width of the input signal DX, as shown in FIG. 7A. In a similar manner, second to fourth clock signals CLX2 to CLX4 and inverted clock signals thereof are input to the shift registers 130 to 150 of the second to fourth systems. Each of the second to fourth clock signals CLX2 to CLX4 rises later than the preceding clock signal by one cycle of the dot clock signal DC.

The shift registers 120 to 150 of each system are each configured to comprise a multi-stage master/slave type of clocked inverter. Concentrating on a description of the first stage of the first shift register 120, a first clocked inverter 121*a* that acts as master is connected in series with an inverter 121*b*, and a second clocked inverter 121*c* that acts as slave is connected to a feedback line that connects the input and output lines of the inverter 121*b*. The master clocked inverter 121*a* inverts and outputs the input signal DX when the first clock signal CLX1 is high. Similarly, the second, slave clocked inverter 121*c* inverts and outputs an output signal of the inverter 121*b* when the first inverted clock signal /CLX1 is high.

Figure 7B:
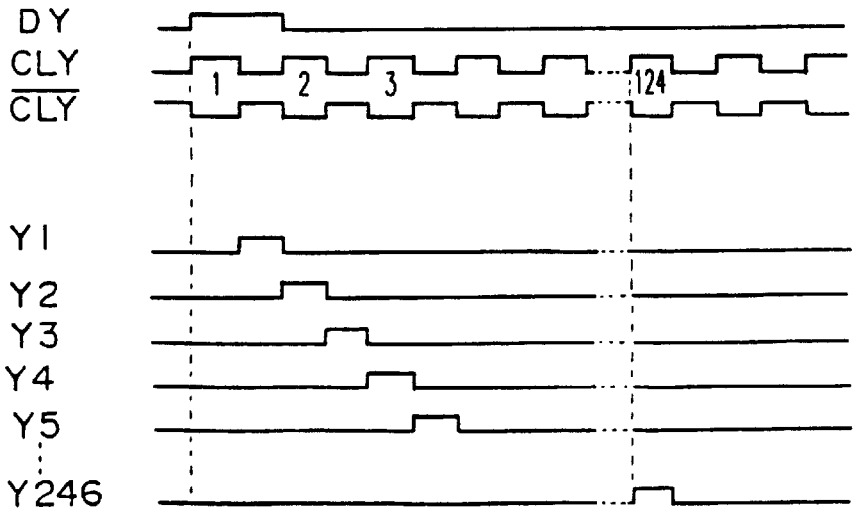
FIG. 7B is a timing chart of the scan-side drive circuit.

The first-stage operation in the shift register 120 for the first system will now be described with reference to the timing chart of FIG. 7A. Note that the signal waveforms that are output from the scan-side drive circuit 102 are considered to be as shown in FIG. 7B.

During the first half portion that the input signal DX is high (for four cycles of the dot clock signal DC), the first clock signal CLX1 is high and the input signal DX is inverted to low and is output as the output of the first clocked inverter 121*a*. This low-level signal is inverted by the inverter 121*b*. Therefore, as the output of the first stage of the first system shift register 120, only the first half portion of the input signal DX is output high as indicated by SR1-OUT1 in FIG. 7A.

During the second half portion of the input clock signal DX, the clock signal CLX1 is low but contrary the first inverted clock signal /CLX1 that is input to the second, slave clocked inverter 121*c* is high. The signal input to this second clocked inverter 121*c* is a high-level signal from the inverter 121*b* so that, as a result, the output from the second clocked inverter 121*c* is the inversion of this input high-level signal and is thus a low-level signal. This low-level signal is inverted by the inverter 121*b*. Therefore, the second half portion of the first output signal SR1-OUT1, which is the output of the first stage of the first-system shift register 120, is also output as a high-level signal.

Note that SR1-OUT1, . . . SR4-OUT1, . . . SR3-OUT2 in FIG. 7A indicate the outputs of the shift registers 120 to 150 of the first to fourth systems. The symbols SR1 to SR4 indicate the shift registers of the first to fourth systems and the symbols OUT1, OUT2, etc., indicate the outputs of the first, second, etc., stages of each of these shift registers.

Each of the second to fourth output signals SR2-OUT1 to SR4-OUT1 is output later than the preceding output signal by one cycle of the dot clock signal DC, by the operations of the first stages of each of the shift registers 130 to 150 of the second to fourth systems, as shown in FIG. 7A.

A fifth output signal SR1-OUT2 is generated by using master/slave clocked inverters of a second stage of the first-system shift register 120.

Figure 32:
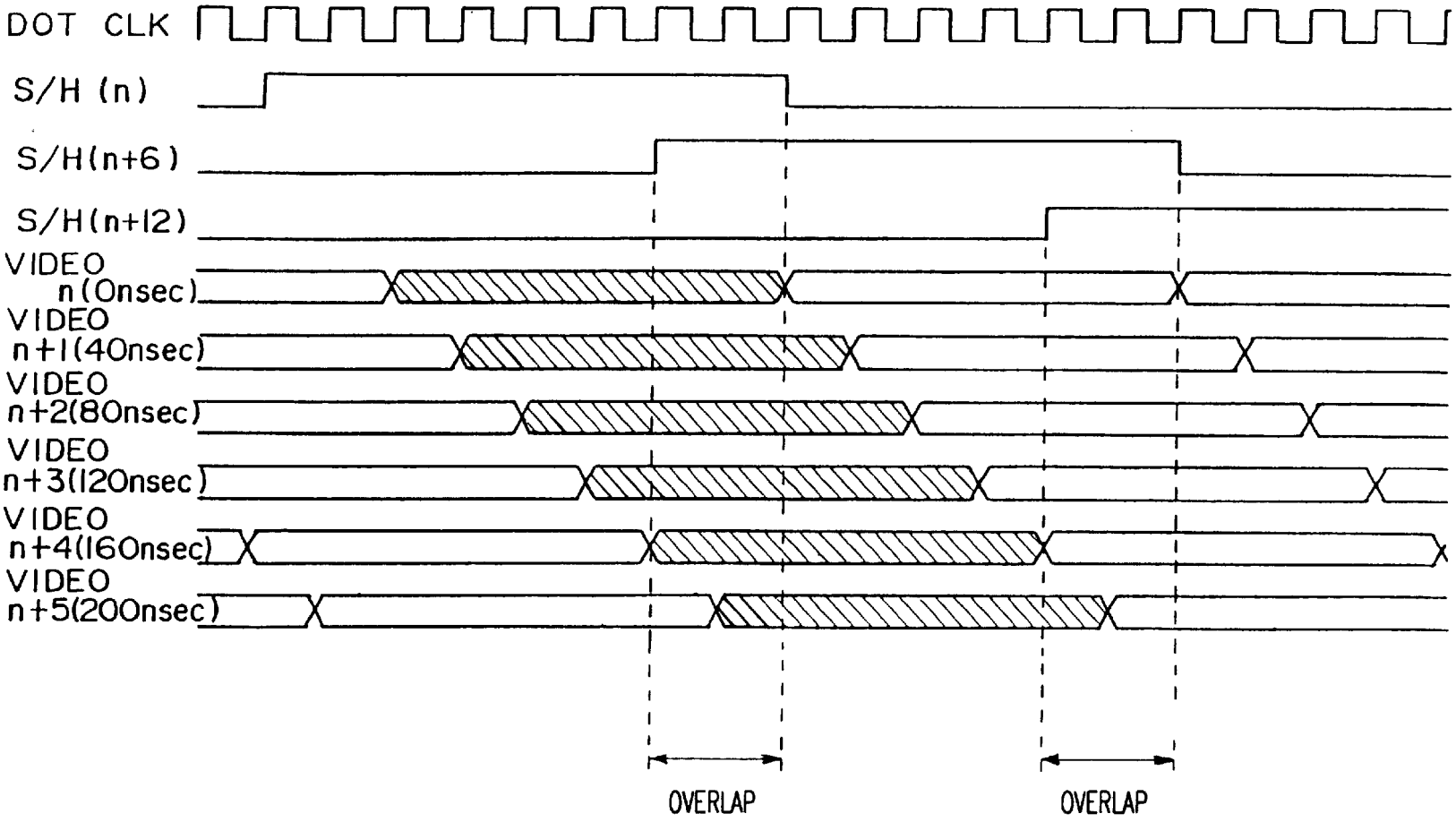
FIG. 32 is a schematic diagram for illustrating. problems that occur during phase expansion.
Figure 33:
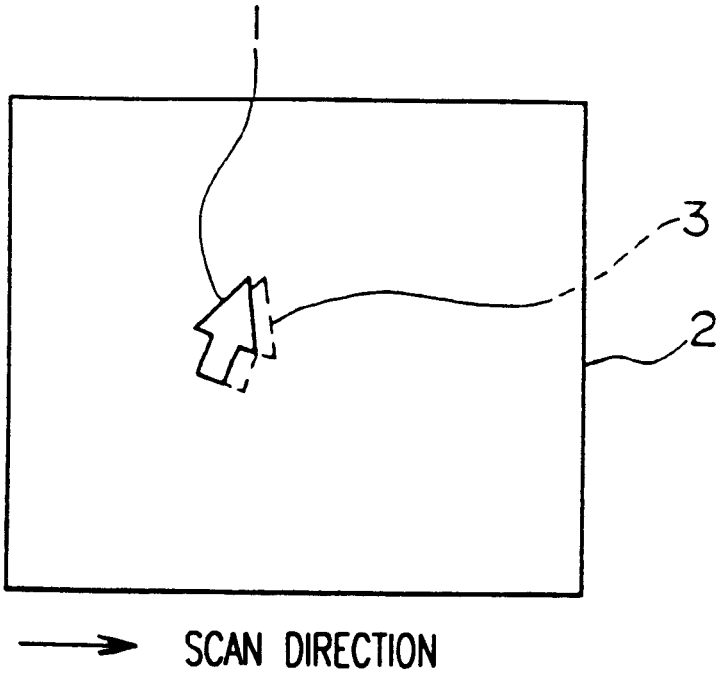
FIG. 33 is a schematic diagram for illustrating ghosting that occurs during image display using the phase-expanded signals of FIG. 32.
Figure 34:
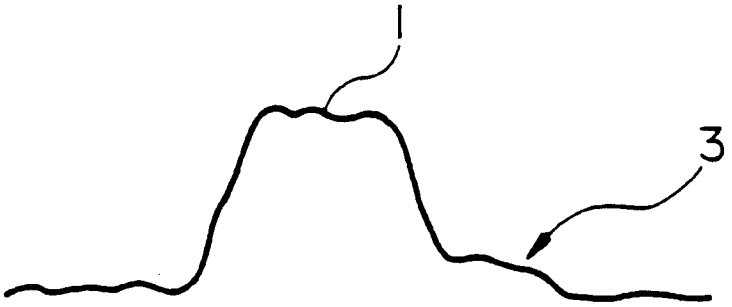
FIG. 34 is a schematic waveform chart of a voltage supplied to a liquid crystal layer, when the waveform causes the ghosting shown in FIG. 33.

If these output signals of the shift registers 120 to 150 of the first to fourth systems were to be output to the sample-and-hold switches 106*a*, 106*b*, etc., without change, the prior-art ghosting phenomenon described previously with reference to FIGS. 32 to 34 would occur.

In this first embodiment of the invention, NAND circuits 160*a*, 160*b*, etc., and inverters 162*a*, 162*b*, etc., are provided between the shift registers 120 to 150 for the first to fourth systems and the sample-and-hold switches 106*a*, 106*b*, etc. These NAND circuits and inverters function as circuits for ANDing the two timing signals that are output from the shift registers.

The first output signal SR1-OUT1 that is output from the first stage of the first-system shift register 120 and the fifth output signal SR1-OUT2 that is output from the second stage thereof are input to the NAND circuit 160*a* provided in the stage before the sample-and-hold switch 106*a* that is connected to the first data signal line 112*a*. Therefore, a sampling signal SL1-Data1 obtained through this NAND circuit 160*a* and the inverter 162*a* in the next stage is an AND of the first output signal SR1-OUT1 and the fifth output signal SR1-OUT2, as shown in FIG. 7A, and a period of time that is four cycles of the dot clock signal DC is set to be the second sampling period.

SL1-Data1, . . . SL4-Data4, etc., of FIG. 7A are applied to the gates of the TFTs of the sample-and-hold switches 106*a*, . . . 106*d*, etc., to turn the respective TFTs on when high. When these signals are expressed as SL(n)-Data(m), m (where m=1 to 6) of the symbol Data(m) refers to the number of the phase-expanded signal lines Data1 to Data6 that is sampled by that signal. The suffix n of SL(n) indicates the sequence number of the sampling signal.

The signal SR2-OUT1 from the first stage of the second-system shift register 130 and the signal SR2-OUT2 from the second stage thereof are input to the NAND circuit 160*b* in the stage before the sample-and-hold switch 106*b* that is connected to the second data signal line 112*b*. Therefore, a second sampling signal SL2-Data2 obtained through this NAND circuit 160*b* and the inverter 162*b* of the next stage is delayed by one cycle of the dot clock signal DC after the first sampling signal SL1-Data1, but the sampling period thereof is the same four cycles of the dot clock signal DC. Note that the operation is the same for each data signal line from the third data signal line onward.

Data Sampling Operation

Figure 8:
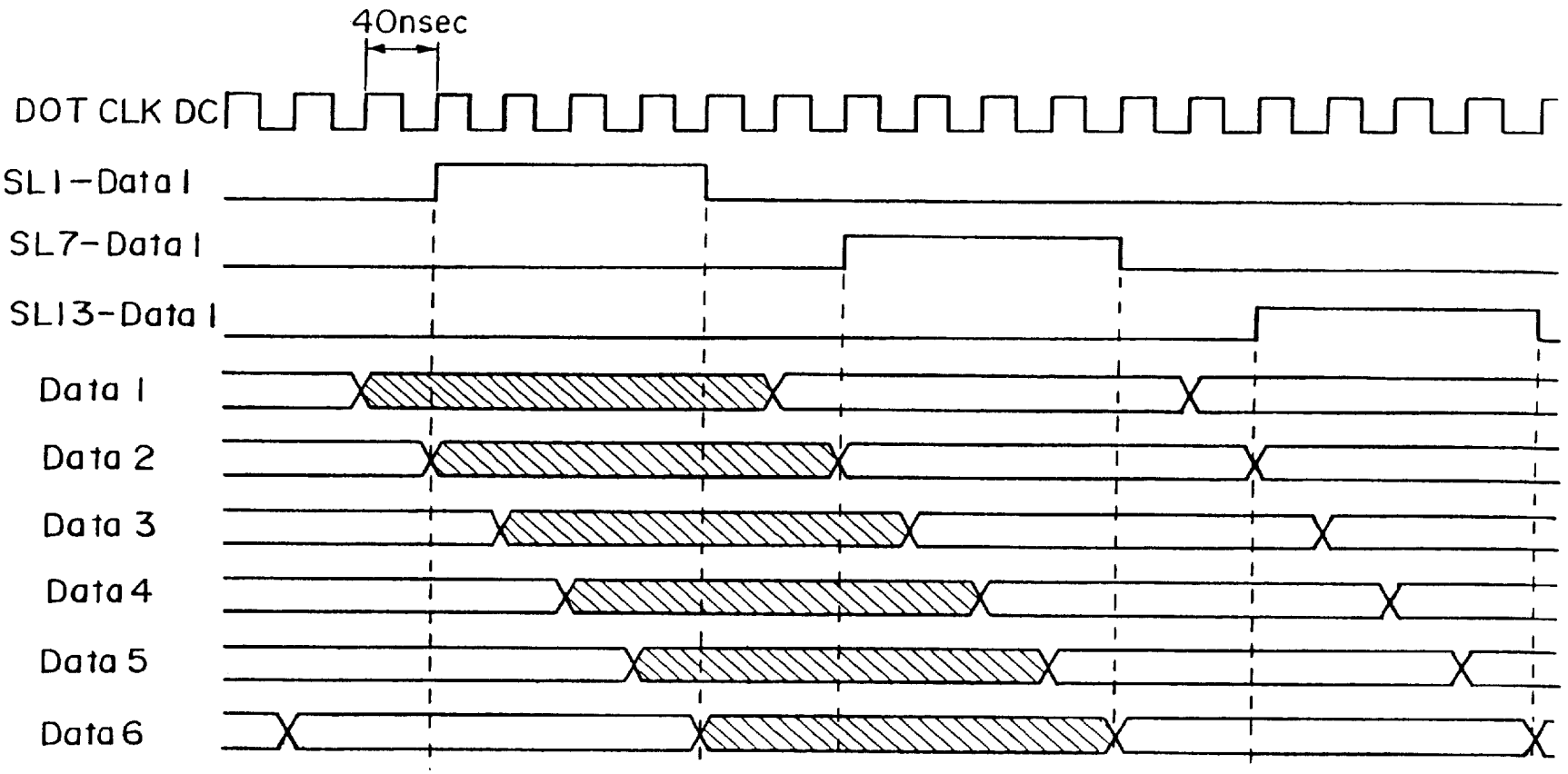
FIG. 8 is a characteristic diagram showing the relationship between the time length of data in the phase-expanded signals of the first embodiment and the sampling period.

The relationship between the phase-expanded signals Data1 to Data6 that are input to the sample-and-hold switches 106 and the sampling signals SL(n)-Data(m) is shown in FIG. 8. In FIG. 8, sampling signals SL1-Data1, SL7-Data1, and SL13-Data1 that sample the phase-expanded signal Data1 are shown. Information in the first sample-and-hold switch 106*a* and having a data length that is six cycles of the dot clock signal DC, as shown in FIG. 8, is input to the source line of the TFT configuring the sample-and-hold switch 106*a*. Similarly, the sampling signal SL1-Data1 is input through the NAND circuit 160*a* and the inverter 162*a* to the gate of the TFT configuring the sample-and-hold switch 106*a*. The sampling signal SL1-Data1 is set to a sampling period (time during which it is high) of four cycles of the dot clock signal, which is one cycle less at beginning and end than the six cycles of the time length of data in the phase-expanded signal.

Setting the sampling period in this manner makes it possible to provide a liquid crystal display wherein the previous data does not affect the display, even if the sample-and-hold switches 106 are configured of TFTs and have the limits of the write capabilities of TFTs. In other words, a liquid crystal display with no ghosting can be provided.

That is because the gates of the TFTs configuring the sample-and-hold switches 106 are opened by the sampling signal going high, after the image data on each phase-expanded signal line has stabilized. Moreover, the gates of the TFTs are closed before the data on these phase-expanded signal lines has changed. Since the sample-and-hold switches 106*a*, 106*g*, 106*n*, etc., connected to the same phase-expanded signal line Data1 are driven in such a manner that there is no overlapping period of time during which SL1-Data1, SL7-Data1, SL13-Data1, etc., are high, there is no point at which a plurality of gates are open simultaneously. Therefore, setting the sampling period to be in a stabilized data region within the data length of the phase-expanded signal ensures that only stabilized data, which is not affected by the previous data, is sent out over the data signal lines 112. This data is written to each liquid crystal layer 116 and holding capacitor through the corresponding switching element 114 that is turned on by the scan signal from the scan-side drive circuit 102.

In a similar manner, stabilized data is thereafter sent through the sampling switches 106*b*, 106*c*, etc., to the sequentially corresponding data signal lines 112*b*, 112*c*, etc., to implement write by point-at-a-time scanning to each liquid crystal layer 116 connected to the first scan signal line 110*a* through the switching elements 114. This data write is subsequently repeated while the switching elements 114 connected to the scan signal lines 110 from the second scan signal line onward are sequentially switched on by the scan signal from the scan-side drive circuit 102.

(2) Second Embodiment

This second embodiment implements a liquid crystal display drive by using phase-expanded signals having a data length that is six cycles of the dot clock signal and a sampling signal having a sampling period that is three cycles of the dot clock signal.

Figure 9:
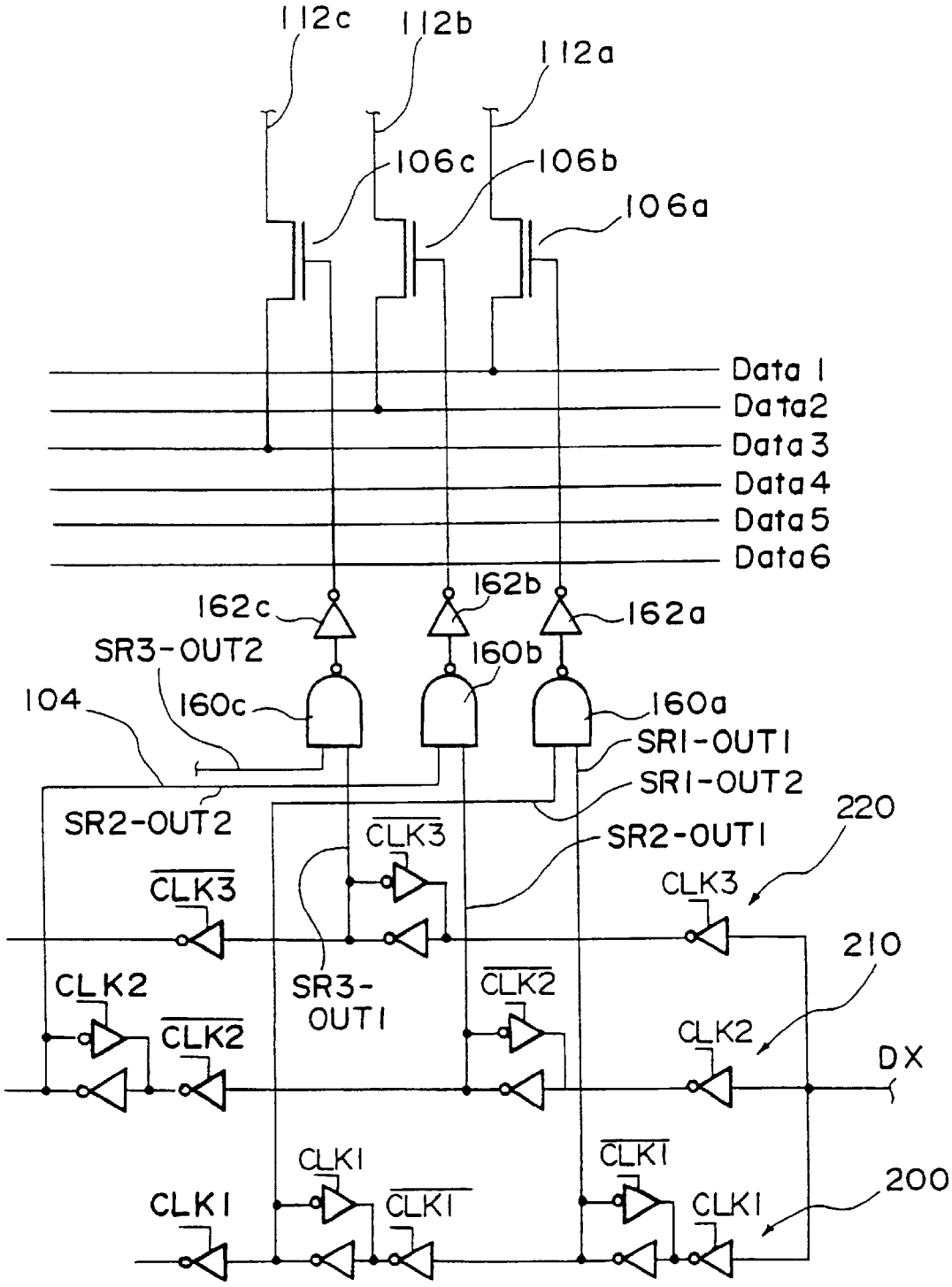
FIG. 9 is a circuit diagram of details of the data-side drive circuit of a second embodiment of this invention.

This embodiment differs from the first embodiment in that the data-side drive circuit and other components of FIG. 6 are modified as shown in FIG. 9.

Figure 10:
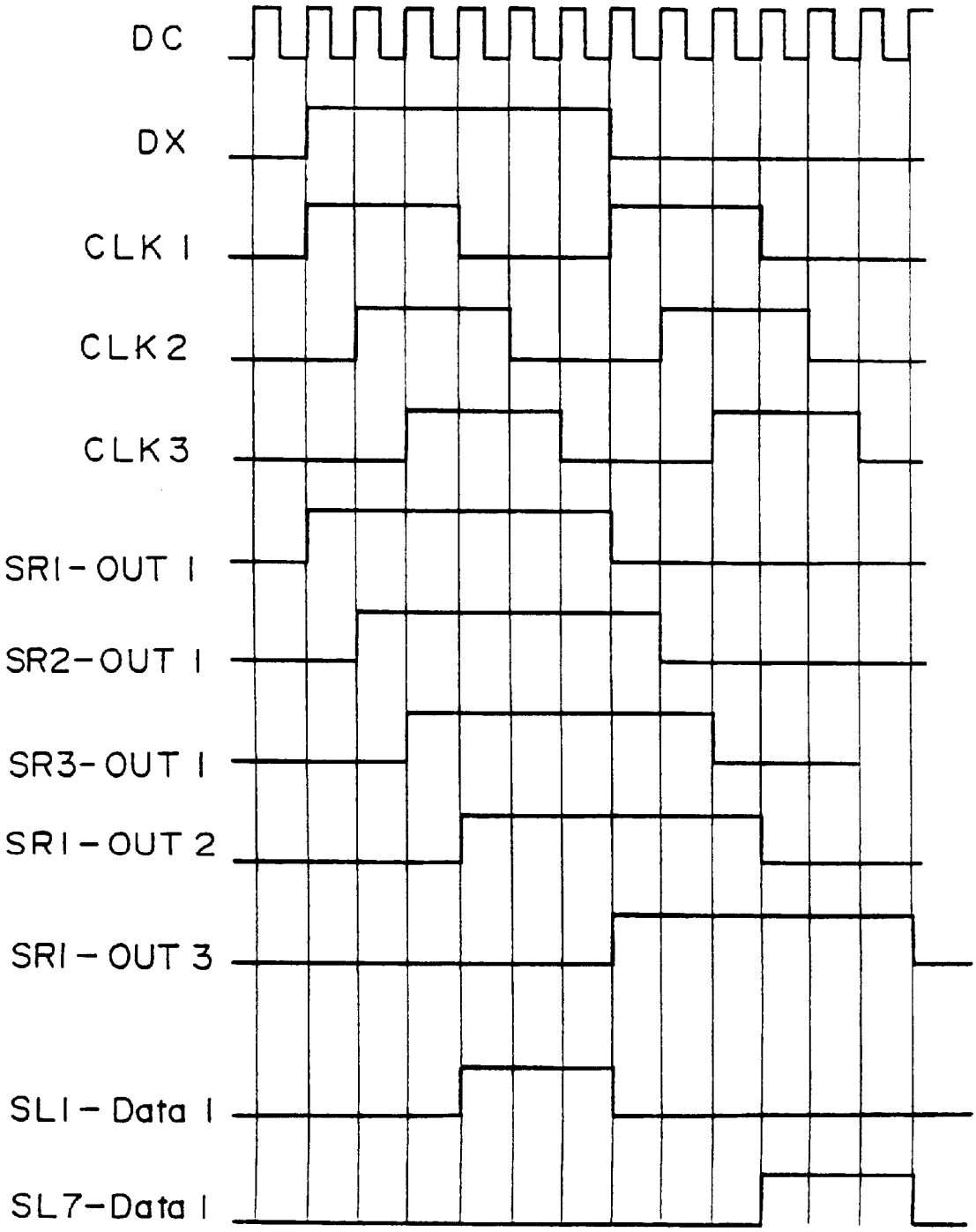
FIG. 10 is a timing chart of the data-side drive circuit of FIG. 9.

The data-side drive circuit 104 shown in FIG. 9 has shift registers 200, 210 and 220 of the first to third systems. These shift registers 200 to 220 receive the input signal DX which is common shift data, as shown in FIG. 10. This input signal DX is high over six cycles of the dot clock signal DC, as shown in FIG. 10. The first-system shift register 200 receives a first clock signal CLK1 and a first inverted clock signal /CKL1 thereof, as shown in FIG. 10. As the first clock signal CLK1, a pulse of half the pulse width of the input signal DX is output repeatedly at a cycle that is the same as the pulse width of the input signal DX, as shown in FIG. 10. In a similar manner, the second- and third-system shift registers 210 and 220 each receive second and third clock signals CLK2 and CLK3 and inverted clock signals /CLK2 and /CLK3 thereof. Each of the second and third clock signals CLK2 and CLK3 rises later than the preceding clock signal by one cycle of the dot clock signal DC.

The shift registers 200 to 220 for the systems are each configured to comprise multi-stage master/slave clocked inverters.

Output signals SR1-OUT1, . . . SR3-OUT2 of these shift registers 200 to 220 of the first to third systems are as shown in FIG. 10.

The first output signal SR1-OUT1 from the first stage of the first-system shift register 200 and the fourth output signal SR1-OUT2 from the second stage thereof are input to the NAND circuit 160*a* provided in the stage before the sample-and-hold switch 106*a* that is connected to the first data signal line 112*a*. Therefore, a sampling signal SL1-Data1 obtained through this NAND circuit 160*a* and the inverter 162*a* in the next stage is an AND of the first output signal SR1-OUT1 and the fourth output signal SR4-OUT2, and a period of time that is high for three cycles of the dot clock signal DC is set to be the sampling period, as shown in FIG. 10.

In a similar manner, the signal SR2-OUT1 from the first stage of the second-system shift register 210 and the signal SR2-OUT2 from the second stage thereof are input to the NAND circuit 160*b* in the stage before the sample-and-hold switch 106*b* that is connected to the second data signal line 112*b*. Therefore, a second sampling signal SL2-Data2 obtained through this NAND circuit 160*b* and the inverter 162*b* of the next stage is delayed by one cycle of the dot clock signal DC after the first sampling signal SL1-Data1, but the sampling period thereof is high for the same three cycles of the dot clock signal DC. Note that the operation is the same for each data signal line from the third data signal line onward.

It should be noted that a seventh sampling signal SL7-Data1 shown in FIG. 10 samples the same phase-expanded signal line Data1 as the first sampling signal SL1-Data1 does. As is clear from FIG. 10, these two sampling periods are not overlapping.

Data Sampling Operation

Figure 11:
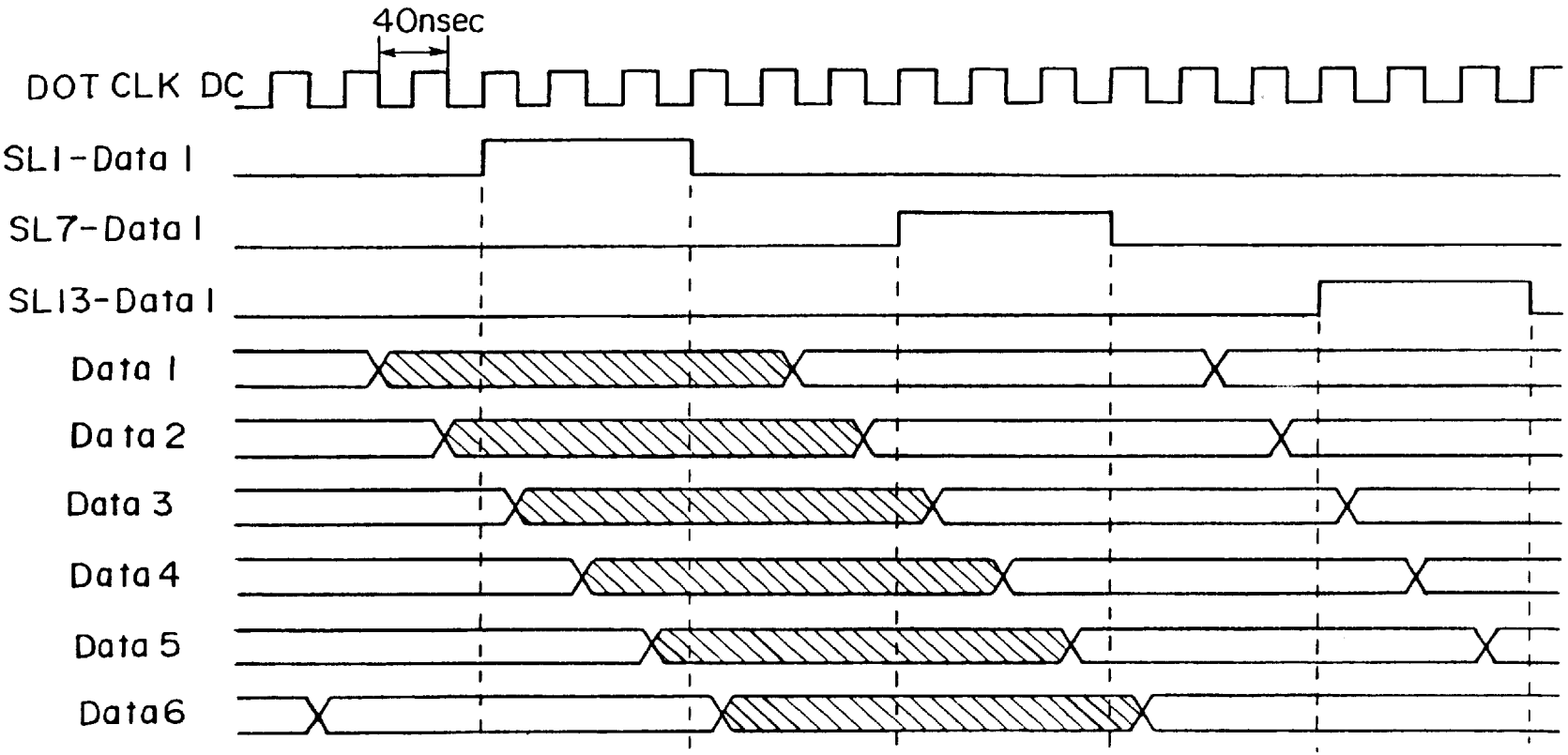
FIG. 11 is a characteristic diagram showing the relationship between the time length of data in the phase-expanded signals of the second embodiment and the sampling period.

The relationship between the phase-expanded signals Data1 to Data6 that are input to sampling switches 102 and the sampling signals SL(n)-Data(m) is shown in FIG. 11. This FIG. 11 shows the same waveforms as those of FIG. 8. For example, information having a time length of data that is six cycles of the dot clock signal DC, as shown in FIG. 11, is input to the source line of the TFT configuring the sample-and-hold switch 106*a*. Similarly, the sampling signal SL1-Data1 is input through the NAND circuit 160*a* and the inverter 162*a* to the gate of the TFT configuring the sample-and-hold switch 106*a*. This sampling signal SL1-Data1 is set to have a sampling period of three cycles of the dot clock signal, which is 1.5 cycles less at beginning and end than the six cycles of the dot clock signal which correspond to the data length of the phase-expanded signal, as shown in FIG. 11. Thus stabilized data that is not affected by previous data can be written, in the same manner as in the first embodiment.

(3) Third Embodiment

This third embodiment implements a liquid crystal display drive by using phase-expanded signals having a data length that is six cycles of the dot clock signal and a sampling signal having a sampling period that is two cycles of the dot clock signal.

Figure 12:
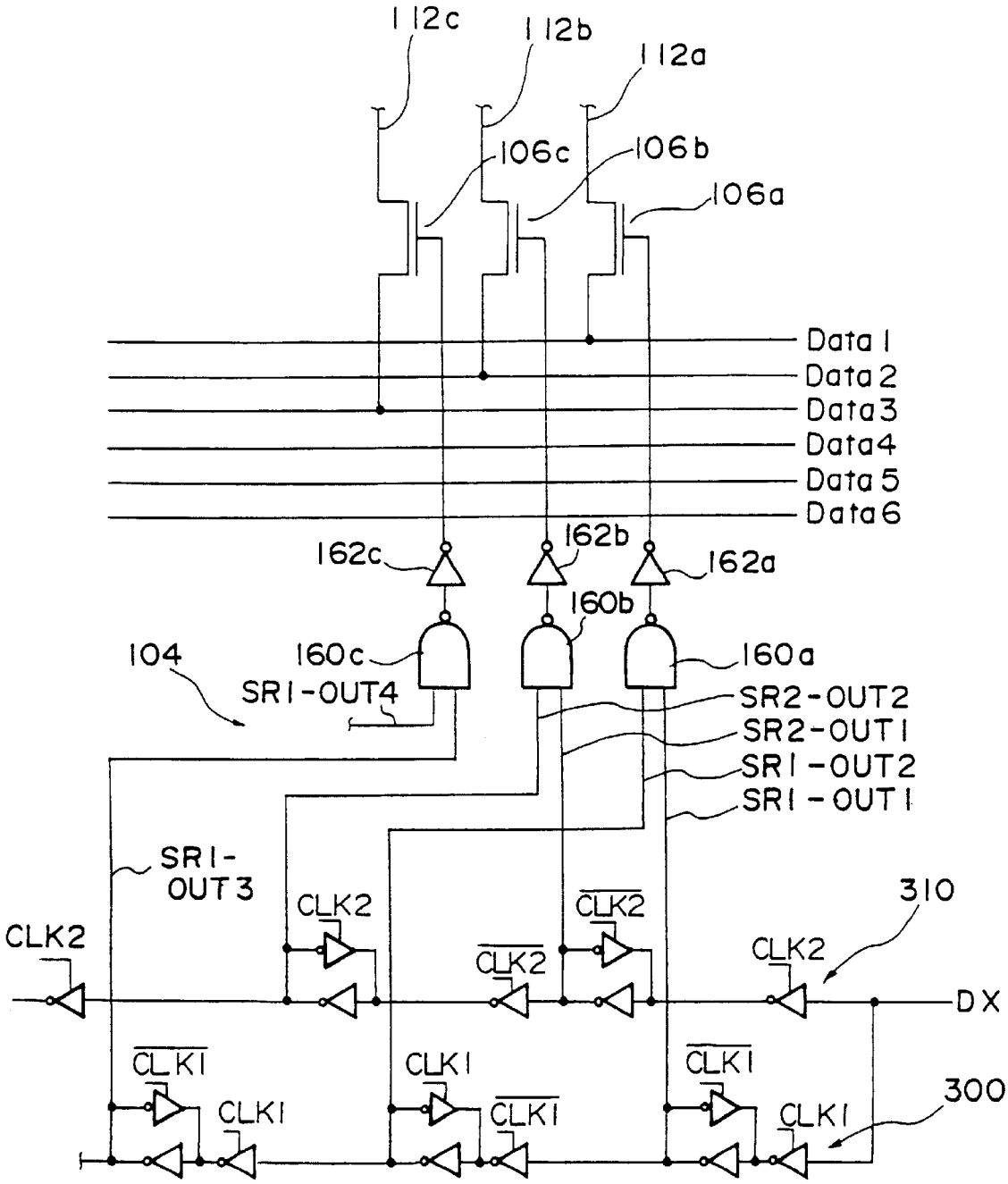
FIG. 12 is a circuit diagram of details of the data-side drive circuit of a third embodiment of this invention.

This embodiment differs from the first embodiment in that the data-side drive circuit and other components of FIG. 2 are modified as shown in FIG. 12.

Figure 13:
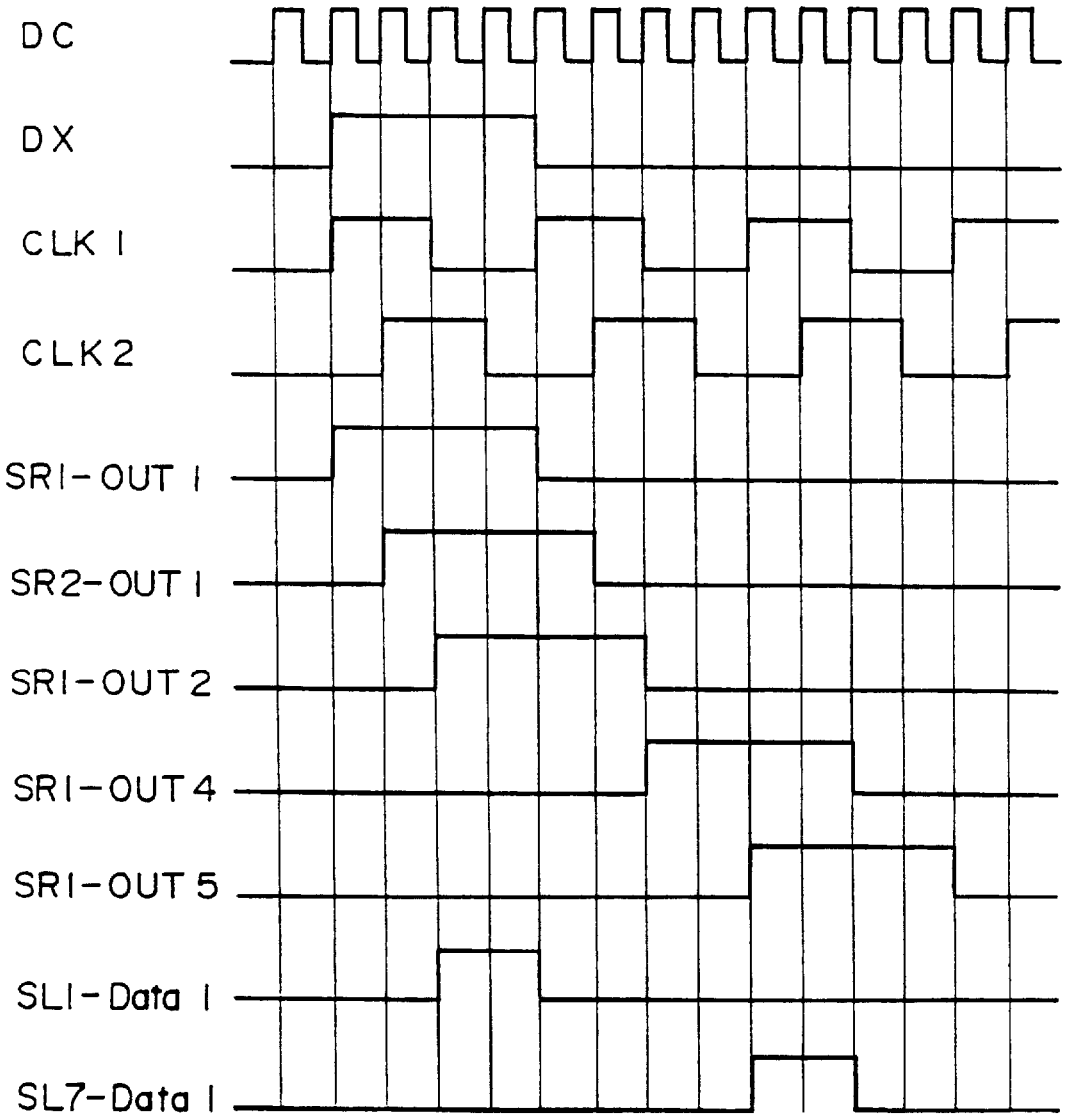
FIG. 13 is a timing chart of the data-side drive circuit of FIG. 12.

The data-side drive circuit 104 shown in FIG. 12 has shift registers 300 and 310 of the first and second systems. These shift registers 300 and 310 receive the input signal DX which is common shift data that is high over four cycles of the dot clock signal DC, as shown in FIG. 13. The first-system shift register 300 receives a first clock signal CLK1 and a first inverted clock signal /CKL1 thereof, as shown in FIG. 12. As the first clock signal CLK1, a pulse of half the pulse width of the input signal DX is output repeatedly at a cycle that is the same as the pulse width of the input signal DX, as shown in FIG. 13. In a similar manner, the second-system shift register 310 receives a second clock signal CLK2 and an inverted clock signal thereof. The second clock signal CLK2 rises later than the first clock signal CLK1 by one cycle of the dot clock signal DC.

The shift registers 300 and 310 are each configured to comprise multi-stage master/slave clocked, inverters.

Output signals SR1-OUT1, . . . SR1-OUT4 of these first- and second-system shift registers 300 and 310 are as shown in FIG. 13.

The first output signal SR1-OUT1 from the first stage of the first-system shift register 300 and the third output signal SR1-OUT2 from the second stage thereof are input to the NAND circuit 160*a* provided in the stage before the sample-and-hold switch 106a that is connected to the first data signal line 112*a*. Therefore, a sampling signal SL1-Data1 obtained through this NAND circuit 160*a* and the inverter 162*a* in the next stage is an AND of the first output signal SR1-OUT1 and the third output signal SR1-OUT2, as shown in FIG. 13, and a period of time that is two cycles of the dot clock signal DC is set to be the sampling period.

In a similar manner, the signal SR2-OUT1 from the first stage of the second-column shift register 310 and the signal SR2-OUT2 from the second stage thereof are input to the NAND circuit 160*b* in the stage before the sample-and-hold switch 106*b* that is connected to the second data signal line 112*b*. Therefore, a second sampling signal SL2-Data2 obtained through this NAND circuit 160*b* and the inverter 162*b* of the next stage is delayed by one cycle of the dot clock signal DC after the first sampling signal SL1-Data1, but the sampling period thereof is the same two cycles of the dot clock signal DC. Note that the operation is the same for each data signal line from the third data signal line onward.

Data Sampling Operation

Figure 14:
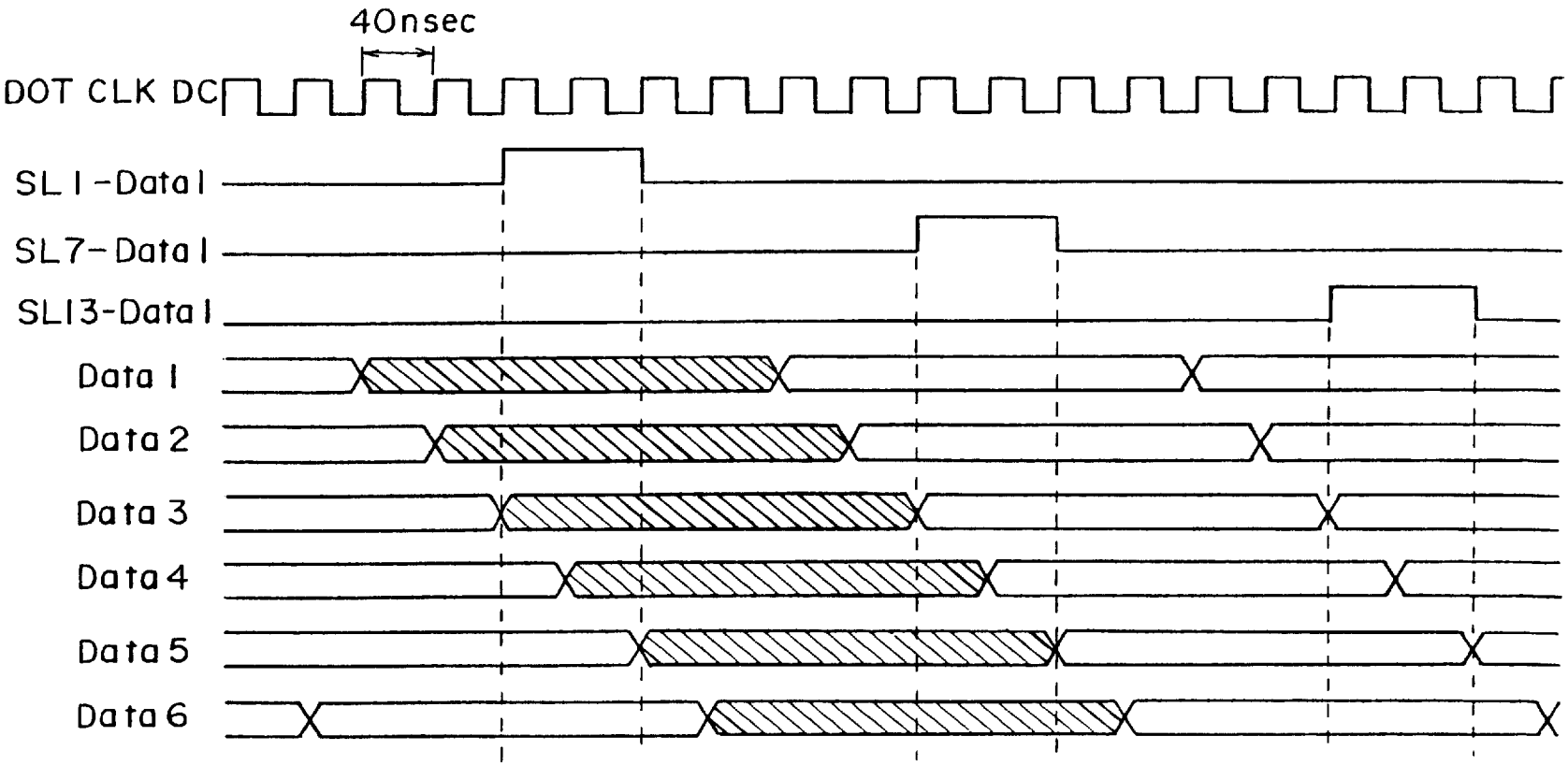
FIG. 14 is a characteristic diagram showing the relationship between the time length of data in the phase-expanded signals of the third embodiment and the sampling period.

The relationship between the phase-expanded signals Data1 to Data6 that are input to the sampling switches 102 and the sampling signals SL(n)-Data(m) is shown in FIG. 14. This FIG. 14 shows the same waveforms as those of FIG. 8. For example, information having a time length of data that is six cycles of the dot clock signal DC, as shown in this figure, is input to the source line of the TFT configuring the sample-and-hold switch 106*a*. Similarly, the sampling signal SL1-Data1 is input through the NAND circuit 160*a* and the inverter 162*a* to the gate of the TFT configuring the sample-and-hold switch 106*a*. This sampling signal SL1-Data1 is set to have a sampling period of two cycles of the dot clock signal, which is two cycles less at beginning and end than the six cycles of the dot clock signal which correspond to the time length of data in the phase-expanded signal. Thus stabilized data that is not affected by previous data can be written, in the same manner as in the first and second embodiments.

(4) Fourth Embodiment

This fourth embodiment modifies the point-at-a-time scanning of the first and third embodiments to provide simultaneous driving of the same number of pixels as the number of expansion phases, such as 6-pixel simultaneous drive. With an engineering workstation (EWS) for instance, the frequency of the dot clock signal is increased (to 130 MHz, for example) and the phase difference for point-at-a-time scanning is no more than 10 ns. If the sample-and-hold switches are TFTs in such a case, the switching cannot possibly follow the increased frequency. It is therefore efficient to drive a plurality of pixels simultaneously in such a case. This fourth embodiment will be described below with reference to FIGS. 15 to 17.

Data Processing Circuit Block Configuration and Phase-Expanded Signals

Figure 17:
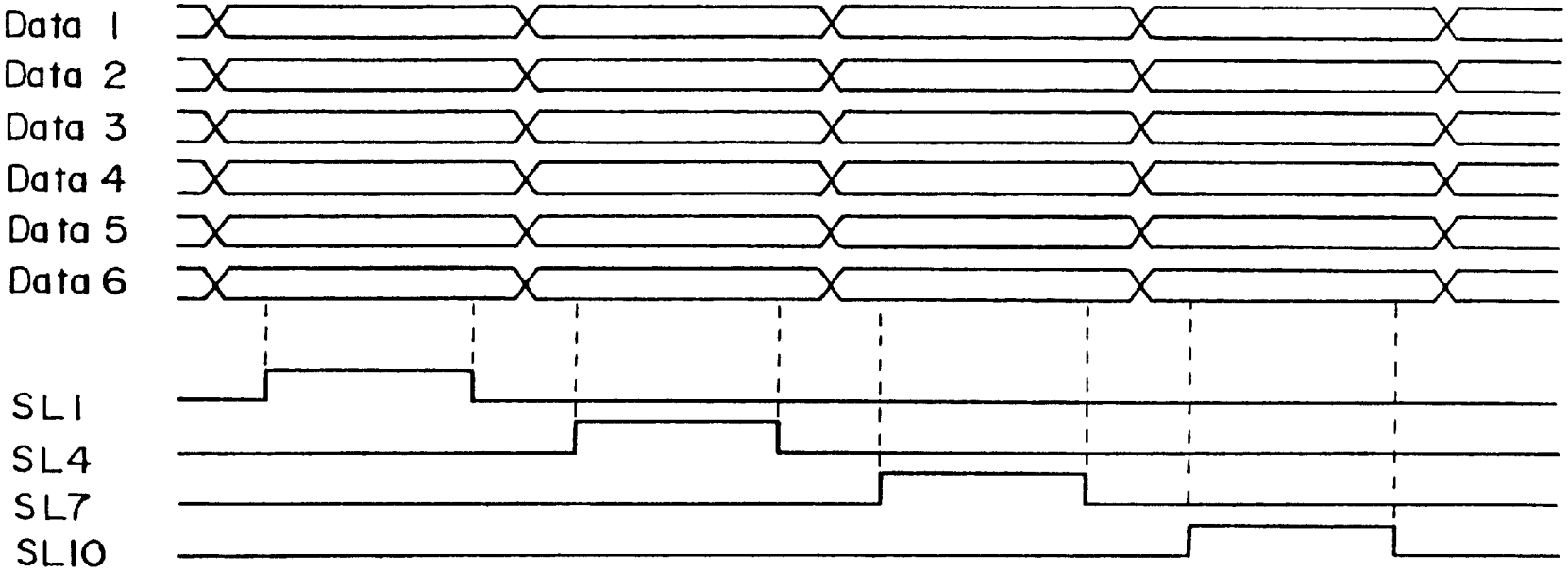
FIG. 17 is a characteristic diagram showing the relationship between the time length of data in the phase-expanded signals of the fourth embodiment and the sampling period.

To enable 6-pixel simultaneous write in this fourth embodiment, first to sixth phase-expanded signals that are output over first to sixth phase-expanded signal lines Data1 to Data6 have head positions for switching between pixel data that are aligned as shown in FIG. 17.

Figure 15:
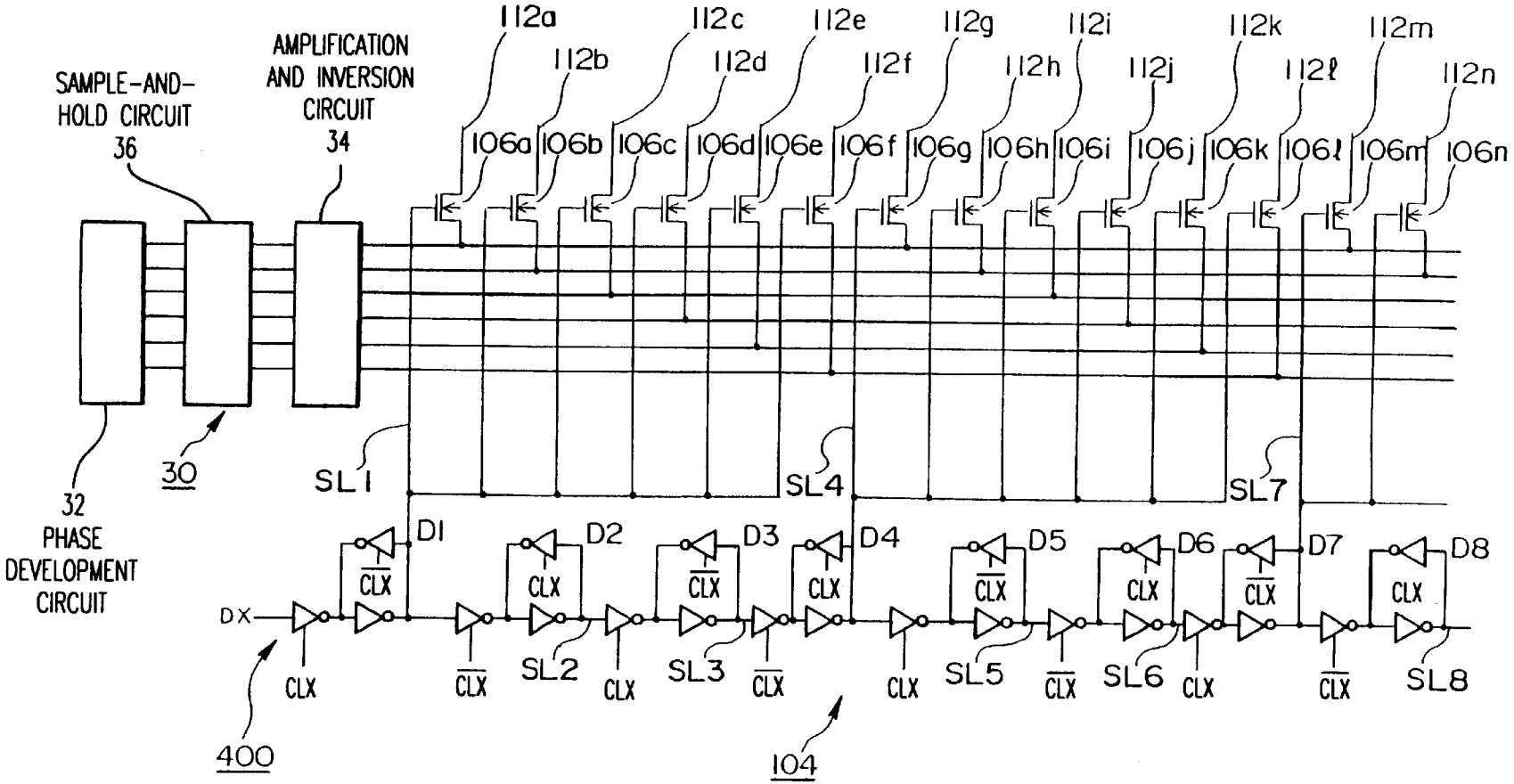
FIG. 15 is a circuit diagram of details of the data-side drive circuit and data processing circuit block of a fourth embodiment of this invention.

Therefore, a data processing circuit block 30 of this fourth embodiment, shown in FIG. 15, is also provided with a sample-and-hold circuit 36 between the phase-expansion circuit 32 and the amplification and inversion circuit 34. A first sample-and-hold operation of the phase-expansion circuit 32 shifts each of the head positions of the pixel data of the phase-expanded signals by one cycle of the dot clock signal DC from the preceding phase-expanded signal, as shown in FIG. 2. However, these are again sampled and held together in the sample-and-hold circuit 36 of the next stage, so that the head positions of the pixel data are aligned in the first to sixth phase-expanded signals output over the first to sixth phase-expanded signal lines Data1 to Data6, as shown in FIG. 17. Note that buffer memory could be used as the sample-and-hold circuit 36 of the next stage. Furthermore, the amplification and inversion circuit 34 could be disposed in the stage before the phase-expansion circuit 32.

Data-Side Drive Circuit Configuration and Operation

Figure 16:
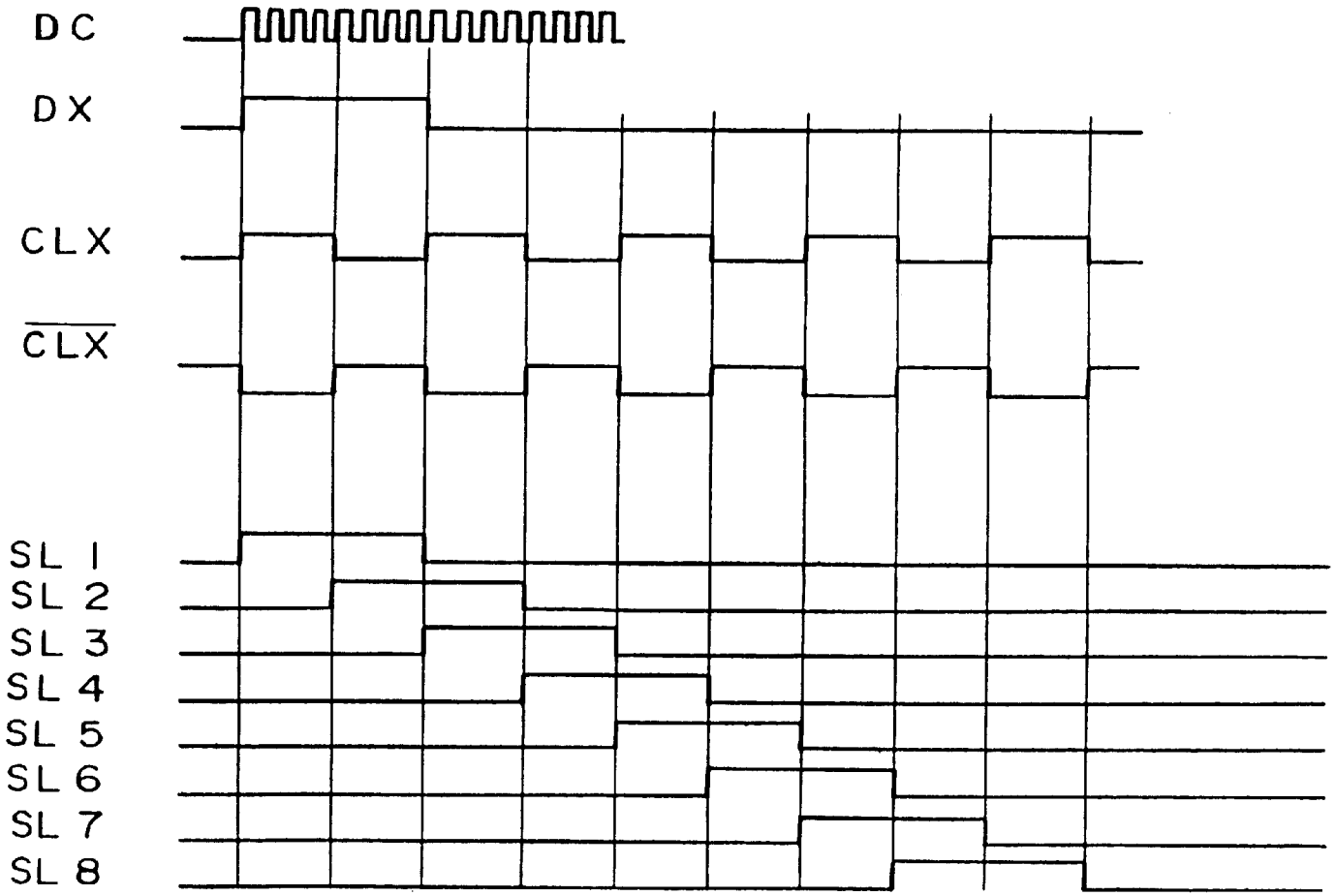
FIG. 16 is a timing chart of the data-side drive circuit of FIG. 15.

As shown in FIG. 15, the data-side drive circuit 104 has a first-system shift register 400. The input signal DX, the clock signal CLK, and the inverted clock signal thereof that are shift data input to the shift register 400, are the same as the input signal DX, the first clock signal CLX, and the inverted clock signal of the first embodiment that are shown in FIG. 7. In other words, the input signal DX is high for eight cycles of the dot clock signal DC, as shown in FIG. 16. As the clock signal CLK, a pulse of half the width of the input signal DX is output repeatedly at a cycle that is the pulse width of the input signal DX, as shown in FIG. 16.

The shift register 400 is configured to comprise a multi-stage master/slave type of clocked inverter. Output signals SL1, . . . SL8 of various stages of the shift register 400 are as shown in FIG. 16.

In this fourth embodiment, the first output signal SL1 from the first stage of the shift register 400 is input in common to the gates of sample-and-hold switches 106*a* to 106*f* that are connected to first to sixth data signal lines 112*a* to 112*f*.

Similarly, the fourth output signal SL4 from the fourth stage of the shift register 400 is input in common to the gates of sample-and-hold switches 106*g* to 106*l* of seventh to twelfth data signal lines 112*g* to 112*l*. Note that the data signal lines from the thirteenth data signal line onward are connected in a similar manner.

As a result, a period of time that is four cycles of the dot clock signal DC is set in common as a sampling period, with respect to a phase-expanded signal of a data length that is six cycles of the dot clock signal DC, as shown in FIG. 17. Thus stabilized data that is not affected by previous data can be written, in the same manner as in the first to third embodiments.

Note that the same input signal DX, clock signal CLX, and inverted clock signal thereof as those of the first embodiment are used by this fourth embodiment, but signals corresponding to those of the second and third embodiments can also be used. If the signals of the second embodiment are used, a period of time that is three cycles of the dot clock signal DC is set in common as the sampling period. Similarly, if the signals of the third embodiment are used, a period of time that is two cycles of the dot clock signal DC is set in common as the sampling period.

(5) Fifth Embodiment

Figure 18:
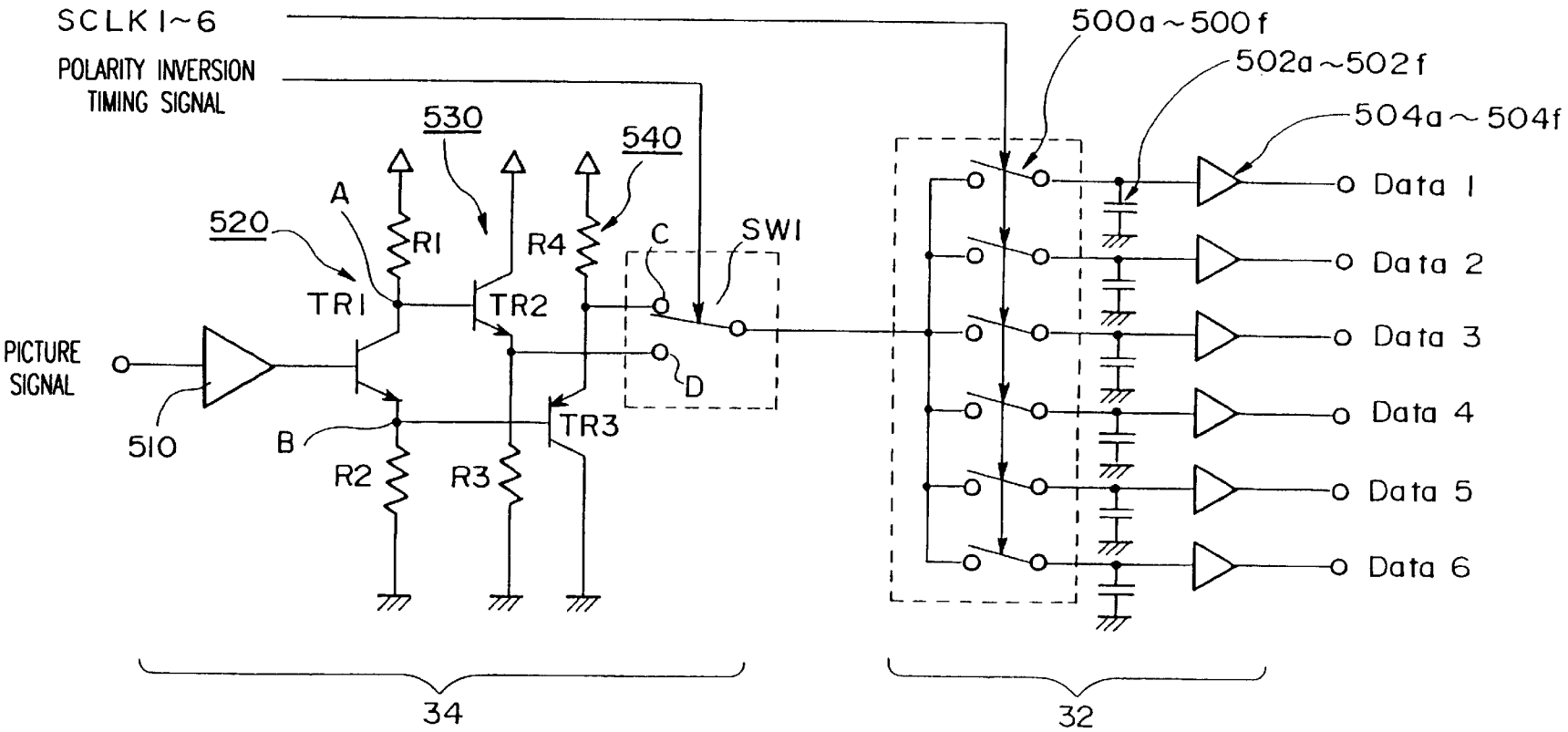
FIG. 18 is a circuit diagram of an example of the configuration of the data processing circuit block of a fifth embodiment of this invention.

This fifth embodiment of the present invention is a variant of the first to third embodiments, wherein the amplification and polarity inversion is performed first by the data processing circuit block 30 and then the 6-phase expansion is implemented, as shown in FIG. 18. In this case, a single amplification and polarity inversion circuit 34 will suffice, as shown in FIG. 18. Therefore, the size of the circuitry can be made smaller than that shown in FIG. 3, and variations in the signal potentials between the six phase-expanded signal lines are reduced to merely the DC offsets of the six sample-and-hold circuits. Note that the variations in the signal potentials between the six phase-expanded signal lines of FIG. 3 are increased since variations in the gain of the six video amplifiers are added. The amplification and polarity inversion circuit 34 could use the configuration shown in FIG. 4B, and this constitution is the same thing regarding the sixth embodiment etc. of this invention which is described below.

(6) Sixth Embodiment

Figure 19:
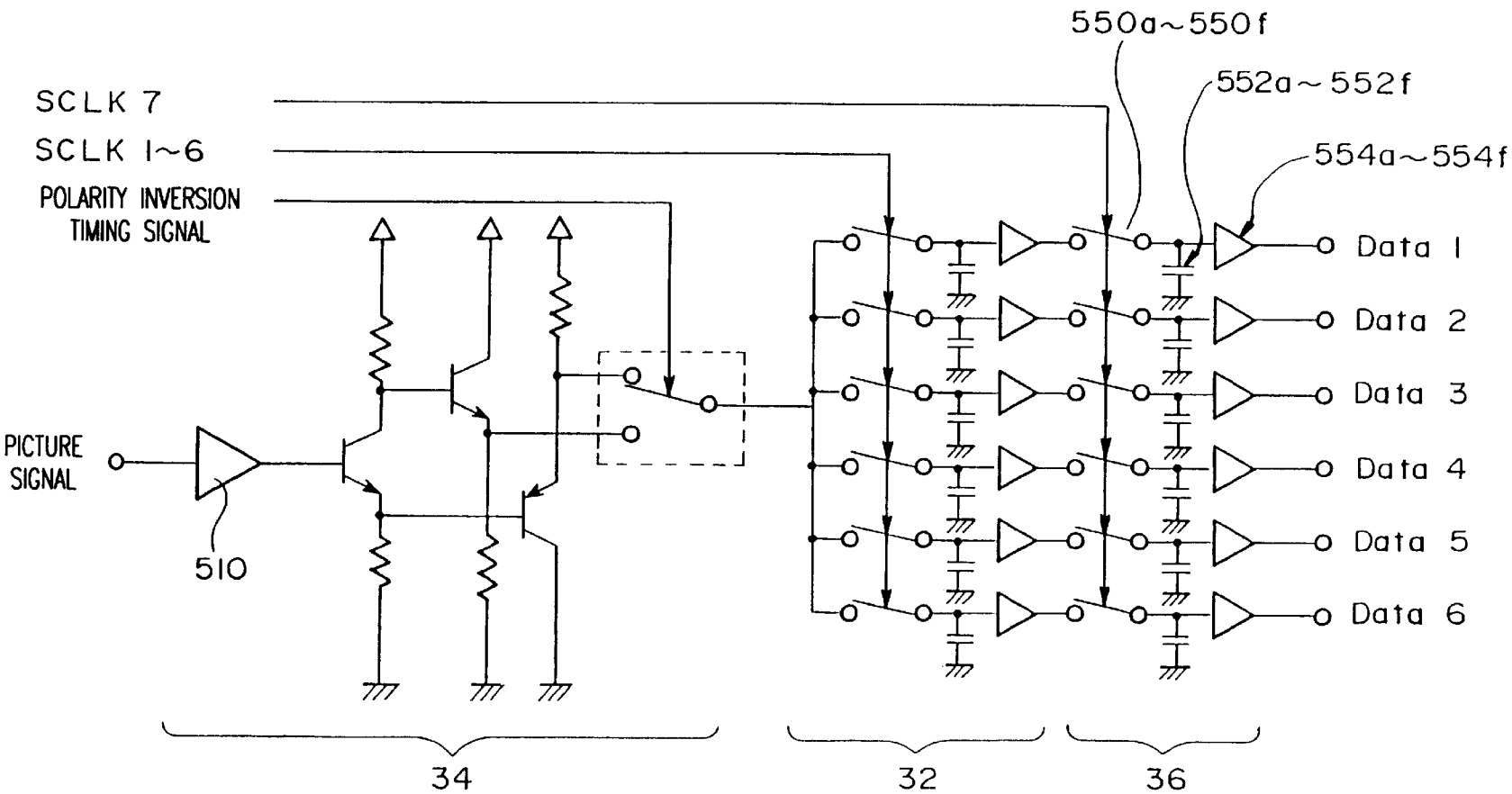
FIG. 19 is a circuit diagram of an example of the configuration of the data processing circuit block of a sixth embodiment of this invention.

This sixth embodiment is a variant of the fourth embodiment, wherein the amplification and polarity inversion is performed first by the data processing circuit block 30 and then the 6-phase expansion is implemented, as shown in FIG. 19, in a similar manner to that of the fifth embodiment. In this case, a single amplification and polarity inversion circuit 34 will suffice, as shown in FIG. 19. Therefore, the size of the circuitry can be made smaller than that shown in FIG. 3 and variations in the signal potentials between the six phase-expanded signal lines are reduced.

Figure 20:
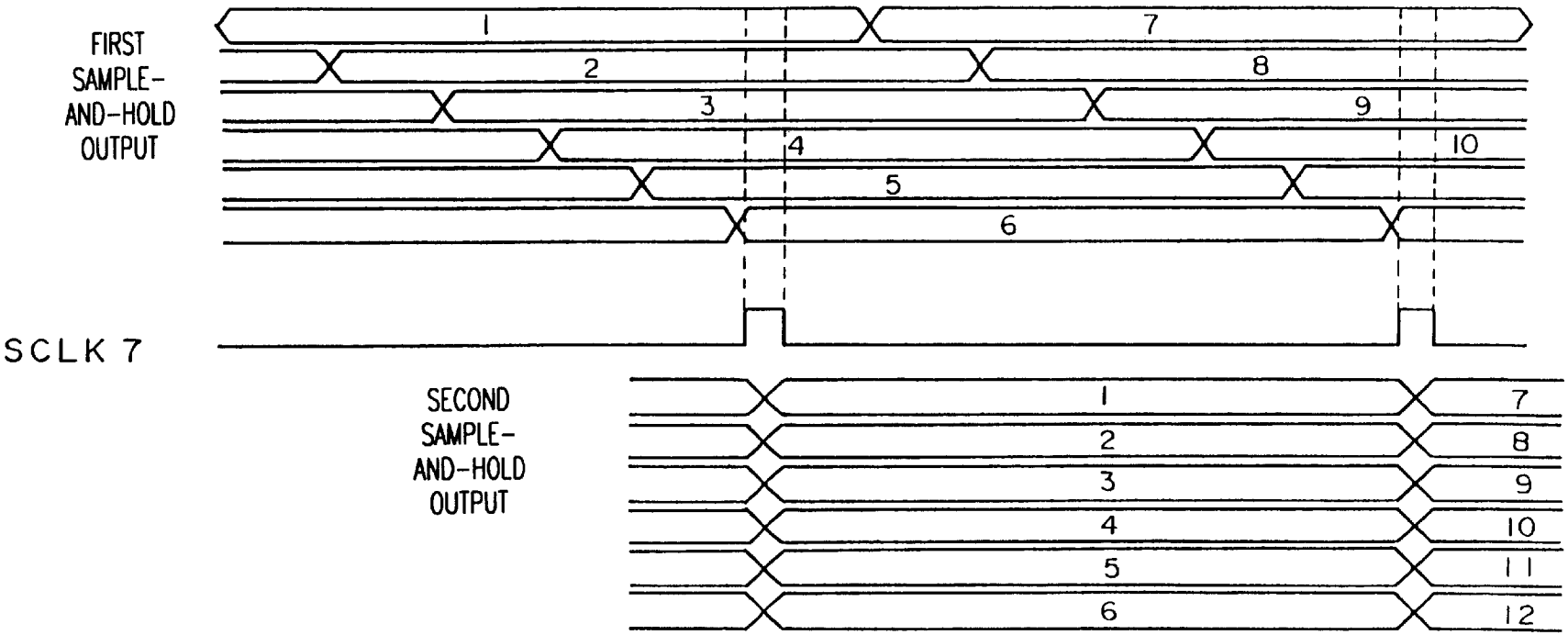
FIG. 20 is a timing chart of the phase-expansion operation of the circuit of FIG. 19.

A timing chart of the operation of the circuit of FIG. 19 is shown in FIG. 20. The outputs of the phase-expansion circuit 32 of FIG. 19 correspond to the first sample-and-hold outputs of FIG. 20 and equal to the six phase-expanded signals as described above. Switches 550*a* to 550*f* provided in the sample-and-hold circuit 36 of FIG. 19 are simultaneously driven on and off on the basis of a sampling clock signal SCLK7 of FIG. 20. As a result, the head positions of pixel data in the outputs of buffers 554*a* to 554*f* of FIG. 19 are aligned, as shown by the second sample-and-hold outputs in FIG. 20.

(7) Seventh Embodiment

Figure 21:
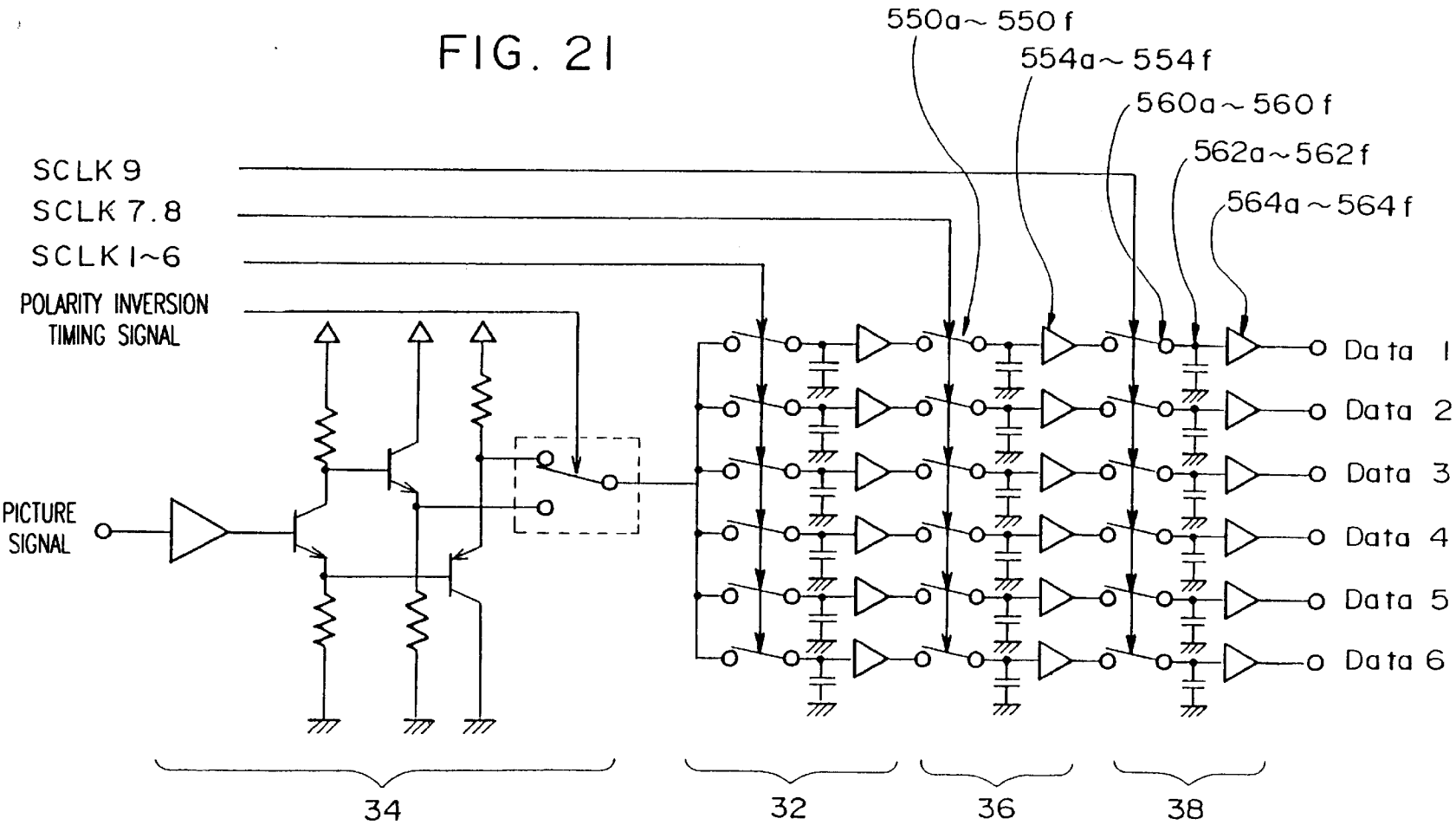
FIG. 21 is a circuit diagram of an example of the configuration of the data processing circuit block of a seventh embodiment of this invention.
Figure 22:
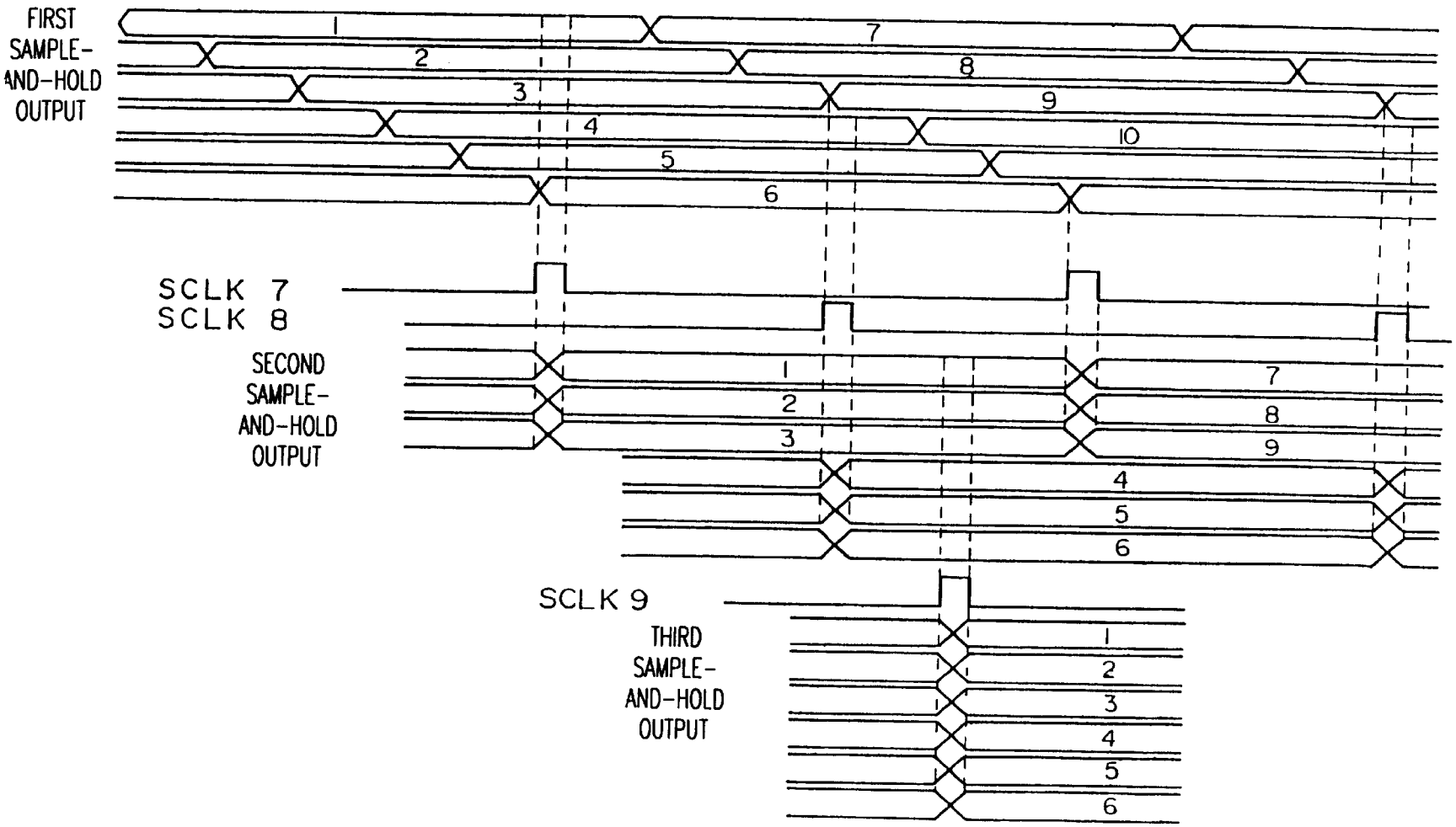
FIG. 22 is a timing chart of the phase-expansion operation of the circuit of FIG. 21.

This seventh embodiment is a variant of FIG. 19, wherein two sample-and-hold circuits 36 and 38 are provided in a stage after the phase-expansion circuit 32, as shown in FIG. 21. A timing chart illustrating the operation of the circuit of FIG. 21 is shown in FIG. 22. The outputs of the phase-expansion circuit 32 of FIG. 21 correspond to the first sample-and-hold outputs of FIG. 22 and equal to the six phase-expanded signals. Switches 550*a* to 550*c* provided in the sample-and-hold circuit 36 of FIG. 21 are simultaneously driven on and off on the basis of a sampling clock signal SCLK7 of FIG. 22. As a result, the head positions of pixel data in the outputs of buffers 554*a* to 554*c* of FIG. 21 are aligned, as shown by the second sample-and-hold outputs in FIG. 22. Switches 550*d* to 550*f* provided in the sample-and-hold circuit 36 of FIG. 21 are simultaneously driven on and off on the basis of a sampling clock signal SCLK8 of FIG. 22. As a result, the head positions of pixel data in the outputs of buffers 554*a* to 554*c* of FIG. 21 are aligned, as shown by the second sample-and-hold outputs in FIG. 22. Switches 560*a* to 560*f* provided in the final-stage sample-and-hold circuit 38 of FIG. 21 are simultaneously driven on and off on the basis of a sampling clock signal SCLK9 of FIG. 22. As a result, the head positions of pixel data in the outputs of buffers 564*a* to 564*f* of FIG. 21 are aligned, as shown by the third sample-and-hold outputs in FIG. 22.

In this manner, each set of data sampling can always be done with respect to the data regions in the six phase-expanded time lengths except for the edges of the data region. This prevents unwanted components from intruding into the waveforms supplied to the display elements of the liquid crystal panel, improving quality.

(8) Eighth Embodiment

With the above described first to seventh embodiments, polarity inversion drive for the liquid crystal panel can be implemented every line or every frame by subjecting the image signal to polarity inversion once every line or once every frame. This eighth embodiment of the invention enables polarity inversion drive at every dot of the liquid crystal panel and also reduces unevenness in the variations in signals between the six phase-expanded signal lines.

Figure 23:
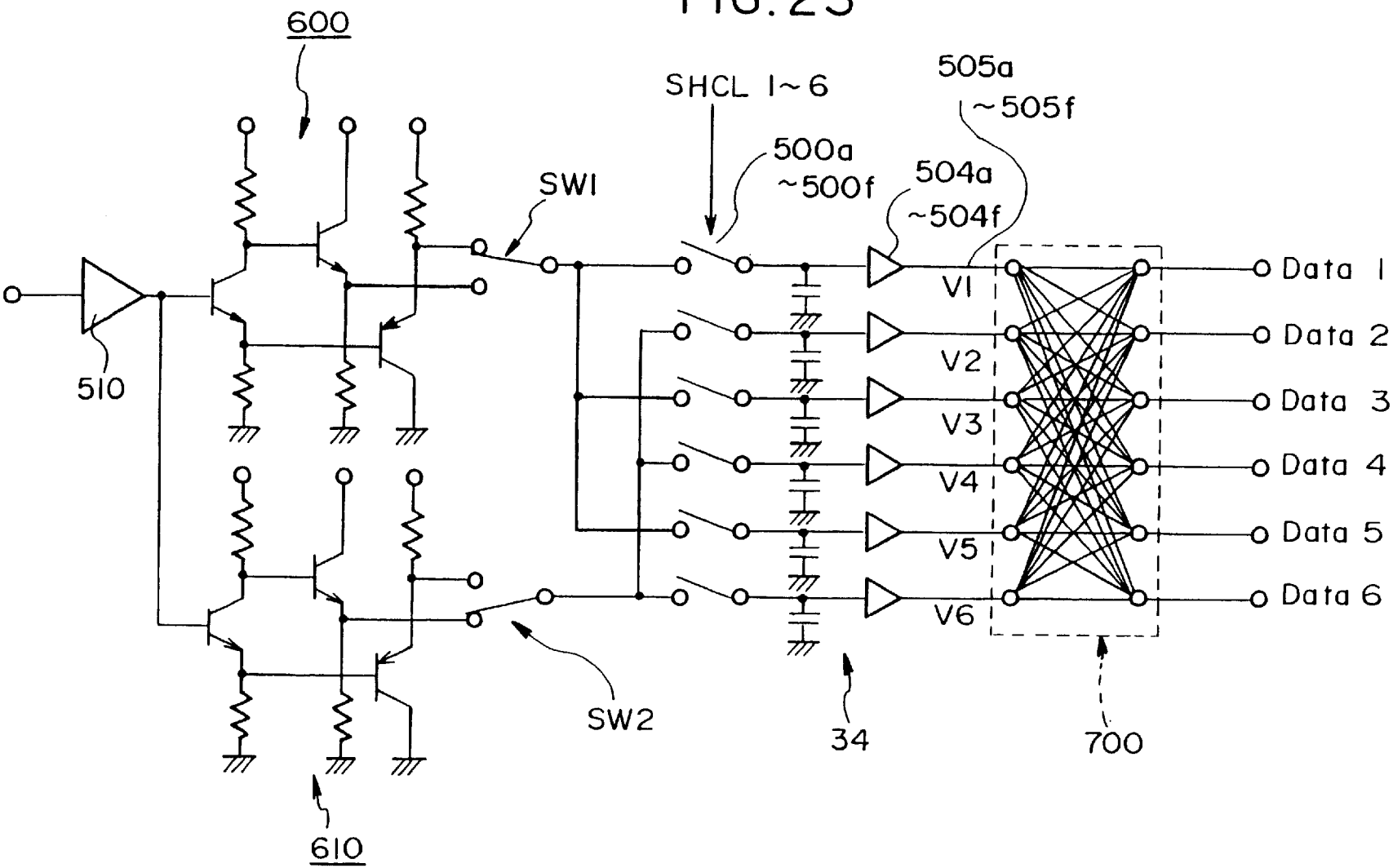
FIG. 23 is a circuit diagram of an example of the configuration of the data processing circuit block of an eighth embodiment of this invention.

This embodiment is provided with first and second polarity inversion circuits 600 and 610 which receive the output from the amplifier circuit 510, as shown in FIG. 23. The circuit configuration of these first and second polarity inversion circuits 600 and 610 is the same as that of FIG. 4, except that each circuit has a final-stage switch: a first switch SW1 and a second switch SW2. For the polarity inversion drive at each dot, these first and second switches SW1 and SW2 are driven to select mutually different polarities. For the polarity inversion drive at each line, or polarity inversion drive at each frame, these first and second switches SW1 and SW2 are driven to select identical polarity.

The output of the first switch SW1 is input to first, third, and fifth switches 500*a*, 500*c*, and 500*e* of the phase-expansion circuit 34. The output of the second switch SW2 is input to second, fourth, and sixth switches 500*b*, 500*d*, and 500*f* of the phase-expansion circuit 34.

Figure 24:
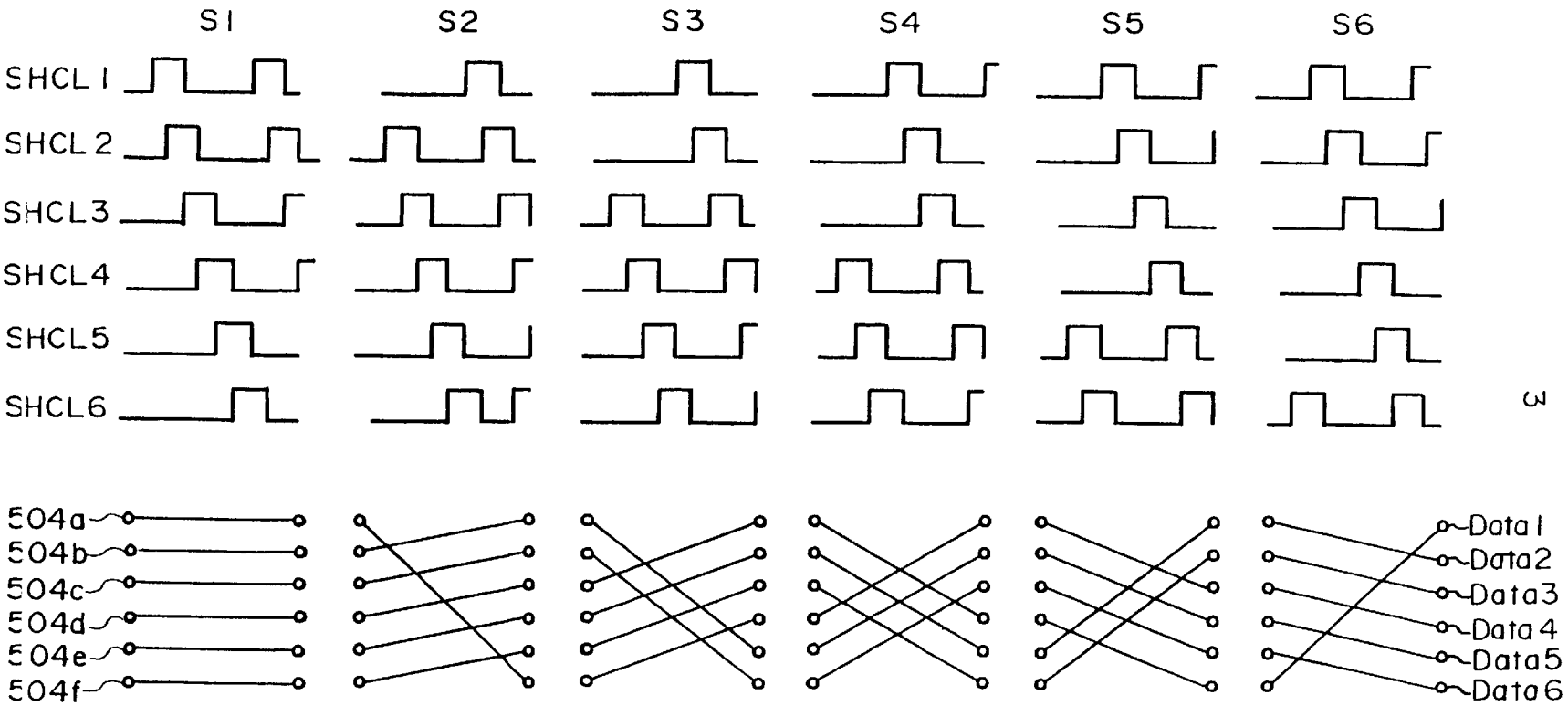
FIG. 24 is a schematic diagram for illustrating the types of sampling signals that are input to the phase-expansion circuit of FIG. 23 and the line connection state during the corresponding switching of the connection switching circuitry.

Six different sampling clock signals SHCL1 to SHCL6 are provided for driving the first to sixth switches 500*a* to 500*f*, as shown in FIG. 24, and these are generated by a timing generation circuit block 20 on the basis of select signals Si to S6. With this device, the six different sampling clock signals SHCL1 to SHCL6 are supplied by selectively switching the select signals S1 to S6, on the basis of the horizontal and vertical synchronization signals for driving the liquid crystal panel 10. For this purpose, a six-digit counter for counting the horizontal synchronization signal is provided within the timing generation circuit block 20. Every time the six-digit counter increments, in other words, every time another of the scan signal lines 110 of FIG. 1 is selected for a horizontal scan (1H), the select signals S1 to S6 are switched sequentially for output.

In this case, the phase-expanded signal outputs of the buffers 504*a* to 504*f*, which are the outputs of the phase-expansion circuit 32, are called V1 to V6. When these outputs V1 to V6 are aligned with the pixel positions, the drive method of FIG. 25 can be considered.

FIG. 25 shows a sampling sequence in which the first line is selected by the select signal S1, the second line by the select signal S2, the third line by the select signal S3, . . . and the sixth line by the select signal S6, and this is repeated for subsequent lines. The plus and minus signs in FIG. 25 indicate polarity, and the method called polarity inversion drive at each dot is enabled by repeatedly switching the first and second switches SW1 and SW2 by a signal from the timing generation circuit block 20. The drive output of FIG. 25 is represented by serial pixel data a1, a2, etc., (for the first line), b1, b2, etc., (for the second line), and it must be supplied to each pixel as shown in FIG. 26.

With this eighth embodiment, a connection switching circuit (rotation circuit) 700 is provided for switching the connections between the six phase-expanded signal output lines 505*a* to 505*f* and the six phase-expanded signal supplying lines Data1 to Data6, in such a manner that the outputs of FIG. 25 are supplied to each pixel as shown in FIG. 26. This switching must be in synchronization with the switching of the above described phase-expansion sequence of the amplification and inversion circuit 34, and thus one of six patterns shown in FIG. 24 is selected on the basis of the signal from the timing generation circuit block 20. This switching makes it possible to implement the dot inversion drive shown in FIG. 26.

In this eighth embodiment, even if there are variations in the gain of the amplifier on the six phase-expanded signal lines, such as a high gain in one amplifier, for example, such variations can be made less noticeable, since bright pixels are not vertically arranged in a line, but obliquely arranged on the liquid crystal panel 100, contrary to the prior art.

(9) Ninth Embodiment

Figure 27:
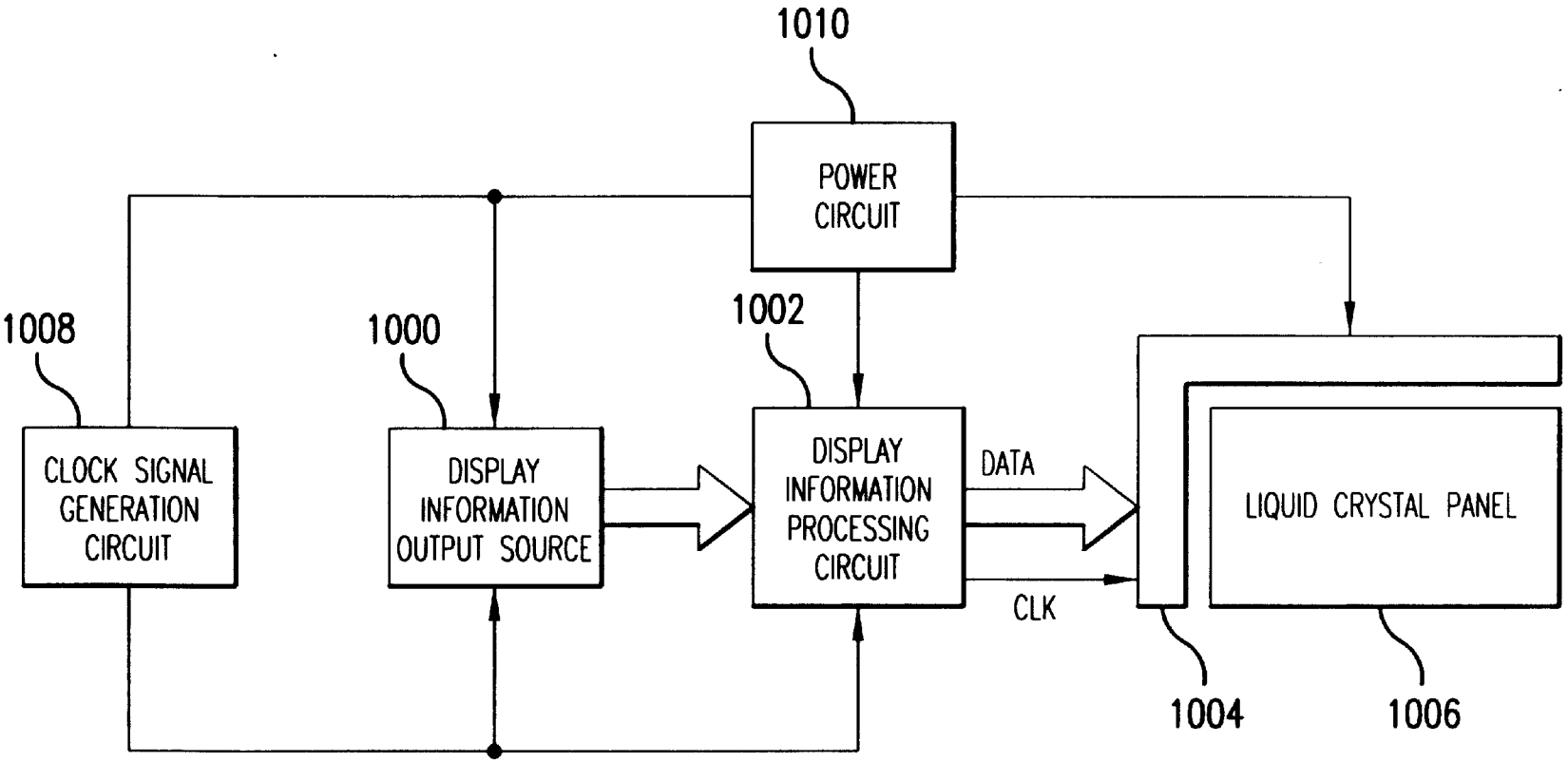
FIG. 27 is a block diagram of electronic equipment in accordance with a ninth embodiment of this invention.

Electronic equipment that uses an image display device in accordance with one of the above described embodiments comprises a display information output source 1000, a display information processing circuit 1002, a display drive circuit 1004, a display panel 1006 such as a liquid crystal panel, a clock signal generation circuit. 1008, and a power circuit 1010, as shown in FIG. 27. The display information output source 1000 comprises memory such as ROM and RAM, and tuning circuitry for tuning and outputting a television signal, and outputs display information such as a video signal on the basis of a clock signal from the clock signal generation circuit 1008 that corresponds to the above described timing generation circuit block 20. The display information processing circuit 1002 corresponds to the data processing circuit block 30 of the above embodiments, and processes and outputs display information on the basis of the clock signal from the clock signal generation circuit 1008. In addition to the above described amplification and polarity inversion circuits, phase-expansion circuits, and rotation circuits, etc., this display information processing circuit 1002 could also comprise components such as a gamma correction circuit and clamp circuit that are known in the art. The display drive circuit 1004 comprises the above described scan-side drive circuit 102 and data-side drive circuit 104, to drive the liquid crystal panel 1006. The power circuit 1010 supplies power to all of the above circuits.

Figure 28:
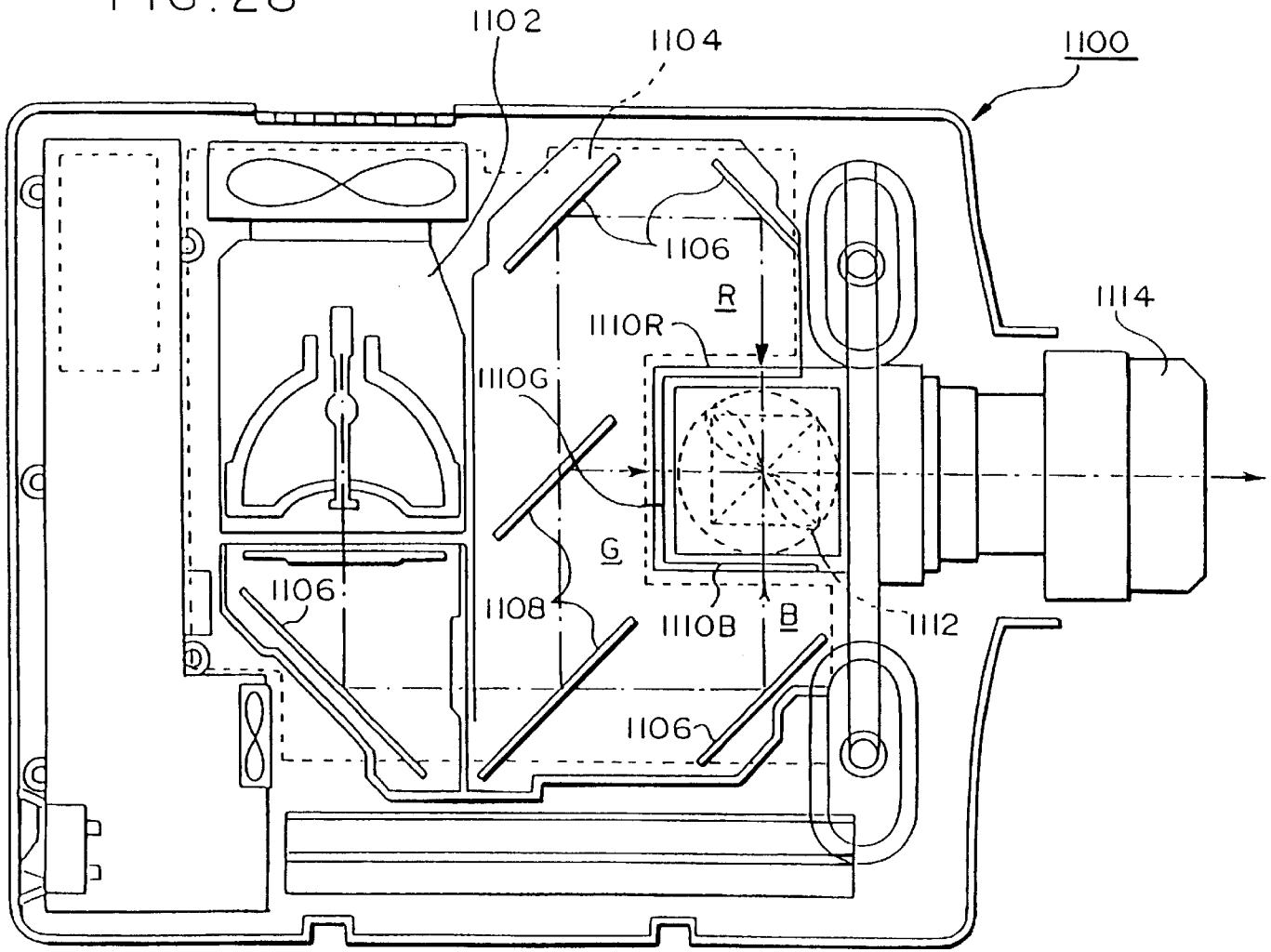
FIG. 28 is a schematic view of a projector to which this invention is applied.
Figure 29:
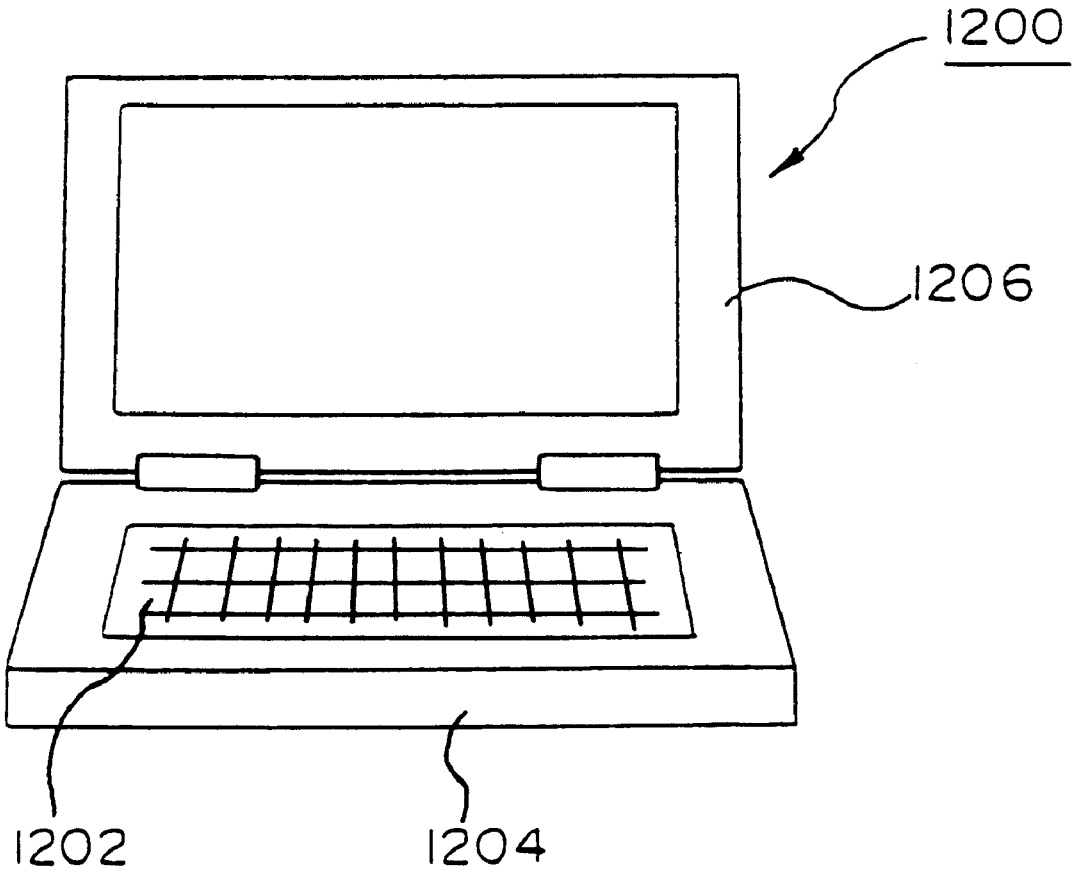
FIG. 29 is an external view of a personal computer to which this invention is applied.
Figure 30:
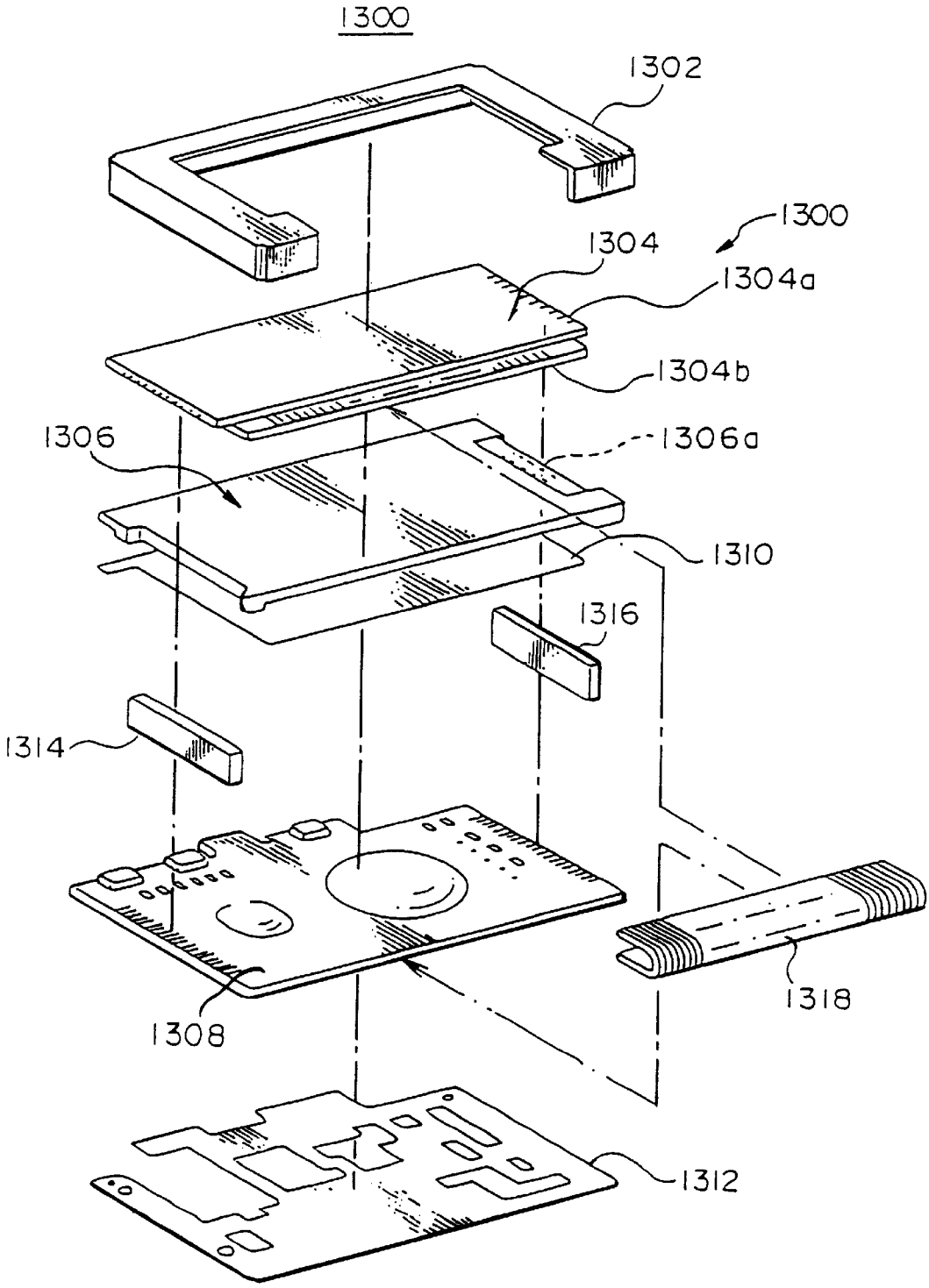
FIG. 30 is an exploded perspective view of a pager to which this invention is applied.

Examples of electronic equipment of the above configuration include: a liquid crystal projector as shown in FIG. 28, a personal computer (PC) or engineering workstation (EWS) capable of providing multi-media as shown in FIG. 29, a pager as shown in FIG. 30, or a portable telephone, wordprocessor, television, view-finder or monitor type of video tape recorder, electronic notebook, electronic calculator, car navigation system, POS terminal, or any device provided with a touch panel.

The liquid crystal projector shown in FIG. 28 is a projector in which a transmission type of liquid crystal panel is used as a valve, using an optical system of three panels-prism type, for example.

In FIG. 28, projection light emitted from a lamp unit 1102 that is a white light source is divided within a light guide 1104 by a plurality of mirrors 1106 and two dichroic mirrors 1108 into the three primary colors red(R), green(G), and blue(B), and each divided light is guided to one of three active matrix type of liquid crystal panels 1110R, 1110G, and 1110B, which displays an image of each color. Light that has been modulated by these three liquid crystal panels 1110R, 1110G, and 1110B is incident from three directions onto a dichroic prism 1112. The dichroic prism 1112 combines the images by bending R light and B light through 90° while allowing G light to pass straight through, so that a color image is projected through a projection lens 1114 and onto an object such as a screen.

The personal computer 1200 shown in FIG. 29 has a main unit 1204 provided with a keyboard 1202, and a liquid crystal display screen 1206.

The pager 1300 shown in FIG. 30 has a liquid crystal display board 1304, a light guide 1306 provided with a backlight 1306*a*, a circuit board 1308, first and second shield plates 1310 and 1312, two elastic conductors 1314 and 1316, and a film carrier tape 1318, all within a metal frame 1302. The two elastic conductors 1314 and 1316 and the film carrier tape 1318 connect the liquid crystal display board 1304 and the circuit board 1308.

The liquid crystal display board 1304 has a liquid crystal inserted between two transparent boards 1304*a* and 1304*b*, to form the basic configuration of a liquid crystal display panel. The display drive circuit 1004 of FIG. 27 can be formed on one of the transparent boards. Moreover, the display information processing circuit 1002 can be added to the display drive circuit 1004. The circuitry that is not mounted on the liquid crystal display board 1304 could be installed as external circuits to the liquid crystal display board, or could be mounted on the circuit board 1308 if the method of FIG. 23 is used.

Figure 31:
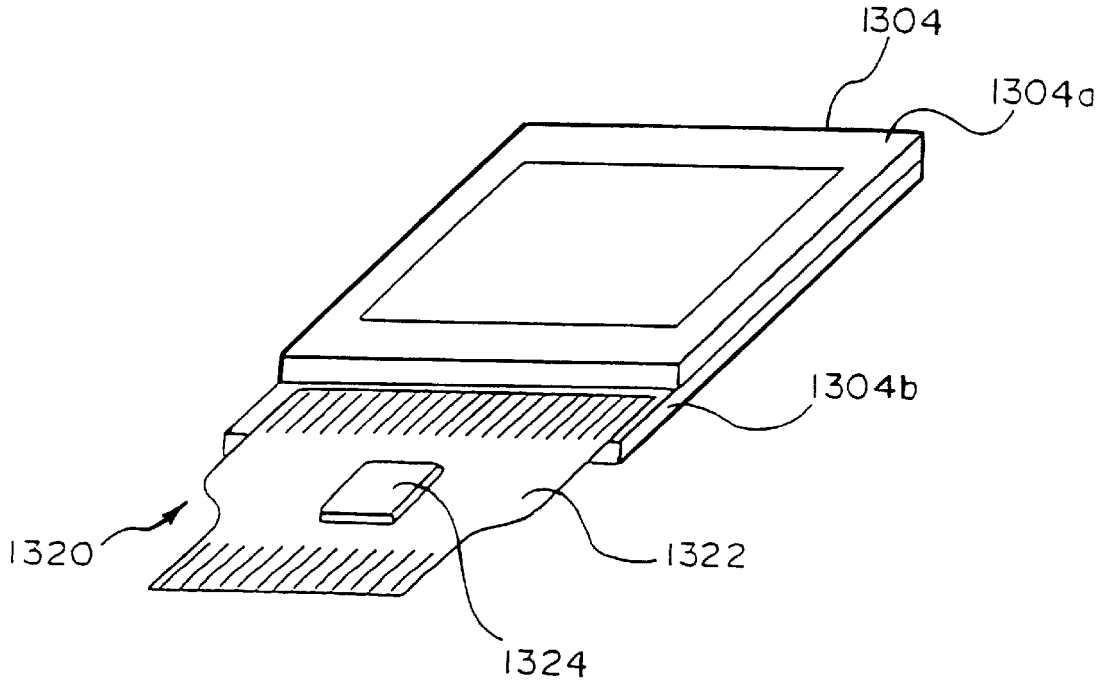
FIG. 31 is a schematic perspective view of an example of a liquid crystal display device provided with an external circuit.

Since FIG. 30 shows the configuration of a pager, the circuit board 1308 is necessary. If, however, the liquid crystal display device is used as one component of an item of electronic equipment, and if the display drive circuit and other circuits can be mounted on a transparent board, the minimum unit of that liquid crystal display device is the liquid crystal display board 1304. Alternatively, a liquid crystal display board 1304 fixed to the metal frame 1302, which acts as a casing, could be used as a liquid crystal display device that is a component of electronic equipment. If a backlighting method is used, the liquid crystal display board 1304 could be assembled within the metal frame 1302 together with the light guide 1306 provided with the backlight 1306*a*, to configure the liquid crystal display device. As a further alternative, a tape carrier package (TCP) 1320, in which an IC chip 1324 is attached on polyimide tape 1322 on which a conductive metal film is formed, could be connected to one of the two transparent boards 1304*a* and 1304*b* that form the liquid crystal display board 1304, as shown in FIG. 31, and this could be used as a liquid crystal display device that acts as one component of an item of electronic equipment.

It should be noted that the present invention is not limited to the above described embodiments and it can be modified in many various ways within the range of the invention. For example, this invention is not limited to the driving of various liquid crystal display devices as described above; it can equally well be applied to image display devices that use electroluminescence, plasma display devices, or CRTs. Similarly, the number of phase expansions, the time length of data in the phase-expanded signals, and the corresponding length of the sampling period can be modified in various ways in addition to those described in the above embodiments.

Furthermore, the above embodiments were described on the basis of examples of phase-expanding an analog image signal for sampling and holding, but the capacitance required for the phase expansion and sampling could equally well be replaced with a digital memory. In such a case, a digital image signal could be converted into phase-expanded signals Data1-1 to Data1-4, . . . Data6-1 to Data6-4 as parallel 4-bit data, and Data1-1 to Data1-4 could be sampled by a latch circuit by the same sampling signal. The output of the latch circuit is then subjected to D/A conversion or pulse width modulation, is output to the data signal lines, and is supplied to each liquid crystal layer 116 through the switching elements 114.

The above embodiments were described as examples of the use of TFTs as switching elements for the pixels, but the switching elements could equally well be 2-terminal elements such as MIMs. In such a case, each pixel is configured of a 2-terminal element and a liquid crystal layer that are connected in series between a scan signal line and a data signal line, so that the differential voltage between the two signal lines is supplied to the pixel.

In the above embodiments, TFTs were used as switching elements, and the substrate on which elements of the liquid crystal panel were formed was of glass or quartz, but a semiconductor substrate could be used instead. In such a case, a MOS transistor is used for each switching element, not a TFT.

What is a claimed is:

1. An image display device comprising:

an image display portion formed of pixels disposed at pixel positions formed by crossing a plurality of data signal lines and a plurality of scan signal lines arranged in a matrix form;

a scan signal line selection circuit that supplies a scan signal to said scan signal lines in sequence;

a phase-expansion circuit that samples an image signal which has time-series data corresponding to each of said pixel positions in accordance with a first sampling period, converting said image signal into a plurality of phase-expanded signals including a plurality of pixel data, respectively, and outputting said phase-expanded signals in parallel, and a time-length of each of said pixel data being longer than said first sampling period;

a plurality of sampling circuits connected to said data signal lines, respectively, each of said plurality of sampling circuits receiving one of said phase-expanded signals, samples said plurality of pixel data in a received phase-expanded signal in accordance with sampling signals having second sampling periods, and supplies sampled pixel data as a data signal to one of said data signal lines; and a sampling signal generator that generates said sampling signals which have said second sampling periods that are each shorter than a period corresponding to a time length of each of said pixel data in said phase-expanded signals, and that supplies said sampling signals to said plurality of sampling circuits.

2. The image display device as defined in claim 1, wherein said phase-expansion circuit outputs said phase-expanded signals in parallel with different head positions of said pixel data in said phase-expanded signals on the basis of a reference clock signal;

wherein said sampling signal generator supplies said sampling signals to said plurality of sampling circuits with different head positions of said second sampling periods of said sampling signals; and wherein said pixels connected to each of said scan signal lines are driven by a point-at-a-time scanning.

3. The image display device as defined in claim 2, wherein said sampling signal generator comprises:

a shift register having a plurality of stages in which an output signal from each stage is output at a timing that partially overlaps a phase of a preceding-stage output signal; and a plurality of AND circuits, each of which is connected to one of said plurality of sampling circuits, receives two of said output signals of mutually overlapping signal phase from said shift register, ANDs said two output signals, and outputs the AND as said sampling signal to said connected sampling circuits.

4. The image display device as defined in claim 1, wherein said phase-expansion circuit outputs said phase-expanded signals in parallel with head positions of said pixel data thereof aligned;

wherein said sampling signal generator supplies said sampling signals to said plurality of sampling circuits connected to said data signal lines, the number of which is equal to the total number of phase-expanded signal lines while said sampling signals start sampling simultaneously; and wherein said pixels connected to each of said scan signal lines are simultaneously driven by a predetermined number which is equal to the total number of said phase-expanded signal lines.

5. The image display device as defined in claim 4, wherein said sampling signal generator comprises a shift register which outputs a signal later than a preceding signal by one cycle of a reference clock signal;

wherein during an mth simultaneous drive {(where: $1 \leqq m \leqq$(total number of pixels on one scan signal line)/(total number of said phase-expanded signal lines)}, the (3m−2)th output of said shift register during one horizontal scanning period is input to said plurality of sampling circuits.

6. The image display device as defined in claim 1, wherein said image display portion is a liquid crystal panel in which a liquid crystal is arranged between a pair of substrates;

wherein said plurality of sampling circuits comprise a plurality of thin-film transistors formed on one of said substrates; and wherein said sampling signals from said sampling signal generator are supplied to gates of said thin-film transistors.

7. The image display device as defined in claim 1, wherein said image display portion is a liquid crystal panel in which a liquid crystal is arranged between a pair of substrates;

wherein said image display portion is driven by applying a voltage that is a difference between voltages applied to one side of said pixels through said data signal lines and another side thereof, into said liquid crystal at said pixel positions to invert a polarity of an electric field applied to said liquid crystal;

wherein said image display device further comprises polarity inversion circuit in a stage before said phase-expansion circuit that receives said image signals, generates a first-polarity image signal which drives said pixels at a first polarity with respect to a polarity inversion reference potential and a second-polarity image signal which drives said pixels at a second polarity that is the opposite of said first polarity, and outputs one of said first- and second-polarity image signals to said phase-expansion circuit; and wherein said phase-expansion circuit performs phase-expansion for said first- and second-polarity image signals and outputs first- and second-polarity phase-expanded signals.

8. The image display device as defined in claim 7, wherein said polarity inversion circuit comprises a first polarity inversion circuit that outputs one of said first- and second-polarity image signals and a second polarity inversion circuit that outputs the other of said first- and second-polarity image signals.

9. The image display device as defined in claim 1, wherein said image display portion is a liquid crystal panel in which a liquid crystal is arranged between a pair of substrates;

wherein said image display portion is driven by applying a voltage that is a difference between voltages applied to one side of each of said pixels through said data signal lines and on another side thereof, into said liquid crystal at said pixel positions to invert a polarity of an electric field applied to said liquid crystal; and wherein said image display device further comprises a plurality of polarity inversion circuits in a stage after said phase-expansion circuit, that receives one of said phase-expanded signals, generates a first-polarity phase-expanded signal which drives said pixels at a first polarity with respect to a polarity inversion reference potential and a second-polarity phase-expanded signal which drives said pixels at a second polarity that is the opposite of said first polarity, and outputs one of said first- and second-polarity phase-expanded signals to said plurality of sampling circuits.

10. The image display device as defined in claim 9, wherein each of said plurality of polarity inversion circuits comprise a first polarity inversion circuit that outputs one of said first- and second-polarity phase-expanded signals and a second polarity inversion circuit that outputs the other of said first- and second-polarity phase-expanded signals.

11. The image display device as defined in claim 9, further comprising:

switching circuits that switch between said first- and second-polarity phase-expanded signals for supply to said plurality of sampling circuits; and a changing control device that controls the change of a phase-expansion sequence performed by said phase-expansion circuit, and also controls the change of destinations of said first- and second polarity phase-expanded signals in said switching elements, in accordance with said phase-expansion sequence.

12. The image display device as defined in claim 1, further comprising:

switching elements that switch between said plurality of phase-expanded signals for supply to said plurality of sampling circuits; and a changing control device that controls the change of a phase-expansion sequence performed by said phase-expansion circuit and also controls the change of destinations of said plurality of phase-expanded signals in said switching elements, in accordance with said phase-expansion sequence.

13. The image display device as defined in claim 7, further comprising:

switching elements that switch between said first- and second-polarity phase-expanded signals for supply to said plurality of sampling circuits; and a changing control device that controls the change of a phase-expansion sequence performed by said phase-expansion circuit, and also controls the change of destinations of said first- and second-polarity phase-expanded signals in said switching elements, in accordance with said phase-expansion sequence.

14. Electronic equipment having an image display device as defined in claim 1.

15. A display drive device that drives an image display portion formed of pixels disposed at pixel positions formed by crossing a plurality of data signal lines and a plurality of scan signal lines arranged in a matrix form, said display drive device comprising:

a scan signal line selection circuit that supplies a scan signal to said scan signal lines in sequence;

a phase-expansion circuit that samples an image signal which has a time-series data corresponding to each of said pixel positions in accordance with a first sampling period, converts said image signal into a plurality of phase-expanded signals including a plurality of pixel data, respectively, and outputs said phase-expanded signals in parallel, and a time length of each of said pixel data being longer than said first sampling period;

a plurality of sampling circuits connected to said data signal lines, respectively, each of said plurality of sampling circuits receives one of said phase-expanded signals, samples said plurality of pixel data in a received phase-expanded signal in accordance with sampling signals having second sampling periods, and supplies sampled pixel data as a data signal to one of said data signal lines; and a sampling signal generator that generates said sampling signals which have said second sampling periods that are each shorter than a period corresponding to a time-length of each of said pixel data in said phase-expanded signals, and that supplies said sampling signals to said plurality of sampling circuits.

16. An image display driving pixels at pixels positions formed by crossing a plurality of data signal lines and a plurality of scan signal lines arranged in a matrix form, said image display method comprising:

a step of sampling an image signal which has a time-series data corresponding to each of said pixel positions in accordance with a first sampling period, converting said image signal into a plurality of phase-expanded signals having a plurality of pixel data, respectively, and outputting said phase-expanded signals in parallel, and a time length of each of said pixel data being longer than said first sampling period;

a step of sampling said plurality of pixel data in each of said phase-expanded signals in accordance with second sampling periods that are each shorter than a period corresponding to a time length of each of said pixel data in said phase-expanded signals; and a step of sequentially selecting said scan signal lines and supplying a plurality of pixel data sampled from said phase-expanded signals to a plurality of said pixels on a selected scan signal line through said data signal lines.

17. An image display device comprising:

an image display portion formed of pixels disposed at pixel positions formed by crossing a plurality of data signal lines and a plurality of scan signal lines arranged in a matrix form;

scan signal line selection means for supplying a scan signal to said scan signal lines in sequence;

phase-expansion means for sampling an image signal which has time-series data corresponding to each of said pixel positions in accordance with a first sampling period, converting said image signal into a plurality of phase-expanded signals including a plurality of pixel data, respectively, and outputting said phase-expanded signals in parallel, and a time-length of each of said pixel data being longer than said first sampling period;

a plurality of sampling means connected to said data signal lines, respectively, each of said plurality of sampling means receiving one of said phase-expanded signals, sampling said plurality of pixel data in a received phase-expanded signal in accordance with sampling signals having second sampling periods, and supplying sampled pixel data as a data signal to one of said data signal lines; and sampling signal generation means for generating said sampling signals which have said second sampling periods that are each shorter than a period corresponding to a time length of each of said pixel data in said phase-expanded signals, and for supplying said sampling signals to said plurality of sampling means.

18. A display drive device for driving an image display portion formed of pixels disposed at pixel positions formed by crossing a plurality of data signal lines and a plurality of scan signal lines arranged in a matrix form, said display drive device comprising:

a scan signal line selection means for supplying a scan signal to said scan signal lines in sequence;

phase-expansion means for sampling an image signal which has a time-series data corresponding to each of said pixel positions in accordance with a first sampling period, converting said image signal into a plurality of phase-expanded signals including a plurality of pixel data, respectively, and outputting said phase-expanded signals in parallel, and a time length of each of said pixel data being longer than said first sampling period;

a plurality of sampling means connected to said data signal lines, respectively, each of said plurality of sampling means receiving one of said phase-expanded signals, sampling said plurality of pixel data in a received phase-expanded signal in accordance with sampling signals having second sampling periods, and supplying sampled pixel data as a data signal to one of said data signal lines; and sampling signal generation means for generating said sampling signals which have said second sampling periods that are each shorter than a period corresponding to a time-length of each of said pixel data in said phase-expanded signals, and for supplying said sampling signals to said plurality of sampling means.

* * * * *